US008312917B2

(12) United States Patent
Schlichting

(10) Patent No.: US 8,312,917 B2
(45) **Date of Patent: *Nov. 20, 2012**

(54) METHOD AND APPARATUS FOR CONTROLLING THE FORMATION OF CROCODILE SKIN SURFACE ROUGHNESS ON THIN CAST STRIP

(75) Inventor: Mark Schlichting, Crawfordsville, IN (US)

(73) Assignee: Nucor Corporation, Charlotte, NC (US)

( * ) Notice: Subject to any disclaimer, the term of this patent is extended or adjusted under 35 U.S.C. 154(b) by 390 days.

This patent is subject to a terminal disclaimer.

(21) Appl. No.: 11/771,772

(22) Filed: Jun. 29, 2007

(65) Prior Publication Data

US 2008/0011449 A1 Jan. 17, 2008

Related U.S. Application Data

(63) Continuation-in-part of application No. 11/302,484, filed on Dec. 13, 2005, now Pat. No. 7,296,614, which is a continuation-in-part of application No. 11/010,625, filed on Dec. 13, 2004, now abandoned.

(51) Int. Cl.
*B22D 11/06* (2006.01)
*B22D 11/16* (2006.01)

(52) U.S. Cl. ..... 164/480; 164/428; 164/452

(58) Field of Classification Search ..... 164/479–482, 164/428–434, 4.1, 451–452, 150.1, 154.1, 164/154.8, 158

See application file for complete search history.

(56) References Cited

U.S. PATENT DOCUMENTS 3,345,738 A 10/1967 Mizikar et al.
3,795,025 A 3/1974 Sadamitsu
4,250,950 A 2/1981 Buxmann et al.
4,530,597 A 7/1985 Itaya et al.
4,793,400 A 12/1988 Wood
4,934,443 A 6/1990 Honeycutt et al.
5,307,861 A 5/1994 Townsend (Continued)

FOREIGN PATENT DOCUMENTS

EP 0 409 645 B1 1/1991

(Continued)

OTHER PUBLICATIONS

International Search Report in PCT/AU2008/001719, dated Feb. 5, 2009.

(Continued)

*Primary Examiner* — Kuang Lin
(74) *Attorney, Agent, or Firm* — Hahn Loeser & Parks, LLP; Arland T. Stein

(57) ABSTRACT

A method of controlling the formation of crocodile skin surface roughness on thin cast strip by forming a casting pool of molten metal of less than 0.065% carbon supported on casting surfaces above a nip, assembling a rotating brush to contact the casting surfaces in advance of contact with the molten metal, and controlling the energy exerted by rotating brushes against the casting surfaces of the casting rolls to clean and expose a majority of the projections of the casting surfaces of the casting rolls by providing wetting contact with the molten metal of the casting pool. The cleaning step is controlled by controlling the energy of the rotating brush against the casting rolls based on the difference between the detected light reflected from the casting surfaces and the light reflected when the casting surfaces are clean, and automating the method.

28 Claims, 19 Drawing Sheets

U.S. PATENT DOCUMENTS

| | | | | |
|---|---|---|---|---|
| 5,575,327 | A | 11/1996 | Kato | |
| 5,590,701 | A | 1/1997 | Fukase | |
| 5,651,413 | A | 7/1997 | Williams et al. | |
| 5,660,224 | A | 8/1997 | Barbe et al. | |
| 5,787,967 | A | 8/1998 | Vendeville et al. | |
| 5,965,277 | A | 10/1999 | Tamaka et al. | |
| 6,125,915 | A * | 10/2000 | Roder et al. | 164/121 |
| 7,296,614 | B2 * | 11/2007 | Schlichting et al. | 164/480 |
| 2002/0088602 | A1 | 7/2002 | Kato et al. | |
| 2002/0166653 | A1 | 11/2002 | Yamamura et al. | |
| 2003/0000679 | A1 * | 1/2003 | Strezov et al. | 164/480 |

FOREIGN PATENT DOCUMENTS

| | | | |
|---|---|---|---|
| EP | 0 714 716 | A1 | 5/1996 |
| EP | 0 865 850 | B1 | 9/1998 |
| EP | 0 887 145 | A1 | 12/1998 |
| FR | 2 771 034 | A1 | 5/1999 |
| JP | 61-193747 | A | 8/1986 |
| JP | 2-99243 | A | 4/1990 |
| JP | 3-161149 | A | 7/1991 |
| JP | 03-165955 | | 7/1991 |
| JP | 03-169460 | * | 7/1991 |
| JP | 3169460 | | 7/1991 |
| JP | 3-210946 | A | 9/1991 |
| JP | 3-216241 | A | 9/1991 |
| JP | 3-230849 | A | 10/1991 |
| JP | 4-66247 | A | 3/1992 |
| JP | 4-187348 | A | 7/1992 |
| JP | 4-187349 | A | 7/1992 |
| JP | 5-177311 | A | 7/1993 |
| JP | 5-223559 | A | 8/1993 |
| JP | 08-039199 | | 2/1996 |
| JP | 08-29401 | | 3/1996 |
| JP | 9-29393 | A | 2/1997 |
| JP | 9-29394 | | 2/1997 |
| JP | 11-207445 | | 8/1999 |
| JP | 2000-280049 | | 10/2000 |
| JP | 2001-58245 | | 3/2001 |
| JP | 2002-113555 | A1 | 4/2002 |
| JP | 2002-210544 | A1 | 7/2002 |
| KR | 2003-0018725 | A | 3/2003 |
| KR | 2003-052333 | * | 6/2003 |
| KR | 2003052333 | | 6/2003 |
| KR | 2004-0020464 | A | 3/2004 |
| WO | 9402269 | | 3/1994 |
| WO | 03/055624 | A1 | 7/2003 |
| WO | 2004/065039 | | 8/2004 |
| WO | 2006064476 | | 6/2006 |

OTHER PUBLICATIONS

Written Opinion in PCT/AU2008/001719, dated Feb. 5, 2009.
PCT/AU2008/000949 International Search Report.
PCT/AU2008/000949 Written Opinion.

* cited by examiner

METHOD AND APPARATUS FOR CONTROLLING THE FORMATION OF CROCODILE SKIN SURFACE ROUGHNESS ON THIN CAST STRIP

This application is a continuation-in-part of application Ser. No. 11/302,484, filed on Dec. 13, 2005, which is a continuation-in-part of application Ser. No. 11/010,625, filed Dec. 13, 2004 and now abandoned.

BACKGROUND AND SUMMARY OF THE DISCLOSURE

This invention relates to the casting of steel strip by a single or a twin roll caster. In a twin roll caster, molten metal is cast into strip through a pair of counter-rotated horizontally positioned casting rolls, which are internally cooled so that metal shells solidify on the moving roll surfaces, and are brought together at the nip between them to produce a thin cast strip delivered downwardly from the nip. The term "nip" is used herein to refer to the general region at which the rolls are closest together. The molten metal may be poured from a ladle into a smaller vessel, such as a tundish, from which it may flow to a distributor and then through a metal delivery nozzle located above the nip forming a casting pool of molten metal supported on the casting surfaces of the rolls. This casting pool is usually confined between side plates or dams held in sliding engagement with end surfaces of the casting rolls so as to dam the two ends of the casting pool against outflow.

When casting steel strip in a twin roll caster, the casting pool will generally be at a temperature in excess of 1550° C., and usually 1600° C. and greater. It is necessary to achieve very rapid cooling of the molten steel over the casting surfaces of the rolls in order to form solidified shells in the short period of exposure on the casting surfaces to the molten steel casting pool during each revolution of the casting rolls. Moreover, it is important to achieve even solidification so as to avoid distortion of the solidifying shells that come together at the nip to form the steel strip. Distortion of the shells can lead to surface defects known as "crocodile skin surface roughness". Crocodile skin surface roughness is known to occur with high carbon levels above 0.065%, and even with carbon levels below 0.065% by weight carbon. Crocodile skin roughness, as illustrated in FIG. 1, is known to occur for other reasons. Crocodile skin roughness involves periodic rises and falls in the strip surface of 40 to 80 microns, in periods of 5 to 10 millimeters, measured by profilometer.

We have found that with carbon levels below 0.065% by weight the formation of crocodile skin surface roughness is directly related to the heat flux between the molten metal and the surface of the casting rolls, and that the formation of crocodile skin roughness can be controlled by controlling the heat flux between the molten metal and the surface of the casting rolls. FIG. 2 reports dip tests that illustrate the relationship between the heat flux and the formation of crocodile skin roughness during the formation of the metal shells on the surfaces of the casting rolls in making the thin cast strip. As shown by FIG. 2, we have also found that by controlling the energy exerted by rotating brushes peripherally in contact with the casting surfaces of each casting roll, in advance of contact of the casting surface with the molten metal, that the heat flux between the molten metal and the surface of the casting rolls, and in turn crocodile skin surface roughness on the resulting thin cast strip, can be controlled.

This relationship between the heat flux from the molten metal and the surface of the casting rolls and the formation of crocodile skin surface roughness on the thin cast strip has been found to occur whether the casting roll surfaces are smooth or textured. FIG. 3 reports dip tests that illustrate how the heat flux is changed with both smooth and textured casting surfaces on the casting rolls. We have also found that the texture of the casting roll surfaces of the casting rolls change during casting. This change can cause a change in heat flux from the molten metal to the casting roll surfaces and in turn a change in formation of crocodile skin surface roughness on the thin cast strip. We have found a method of directly controlling the formation of crocodile skin surface roughness by controlling the heat flux between the molten metal and the casting roll surfaces, to avoid high fluctuations in the heat flux during the formation of the metal shells during casting and in turn control the forming of crocodile skin surface roughness in the thin cast strip produced.

A method of controlling the formation of crocodile skin surface roughness comprises the steps of:

- directing an electromagnetic beam source toward the surface of thin cast strip following discharge from casting surfaces of a twin roll caster;
- detecting reflectance of the electromagnetic beam source from the surface of the thin cast strip;
- processing the detected reflectance from the surface of the thin cast strip to measure the degree of roughness of the surface of the thin cast strip; and
- based on the measured degree of roughness, controlling the degree of cleaning of the casting surfaces by controlling energy exerted by brushes against the casting surfaces of the twin roll caster to control crocodile skin roughness of the thin cast strip.

Alternately, the method of controlling the formation of crocodile skin surface roughness in continuous casting of thin cast strip is disclosed that comprises the steps of:

- assembling a pair of counter-rotating casting rolls laterally to form a nip between circumferential casting surfaces of the rolls through which metal strip may be cast;
- forming a casting pool of molten metal of carbon steel of less than 0.065% by weight carbon supported on the casting surfaces of the casting rolls above the nip;
- assembling a rotating brush peripherally to contact the casting surface of each casting roll in advance of contact of the casting surfaces with the molten metal in the casting pool;
- directing at least one electromagnetic beam source toward at least one of the casting roll surfaces;
- detecting the reflectance of at least one electromagnetic beam source from the casting roll surface directed to the surface from the electromagnetic beam source and generating an electronic signal corresponding to the detected reflectance from the casting surface;
- monitoring the degree of cleaning of the casting surfaces of the casting rolls based on the detected reflectance of the electromagnetic beam source from the casting surface of the casting rolls;
- controlling the energy exerted by the rotating brushes against the casting surfaces of the casting rolls based on the monitored degree of cleaning to expose a majority of projections of the casting surfaces of the casting rolls and provide wetting contact between the casting surface and the molten metal of the casting pool; and
- counter-rotating the casting rolls such that the casting surfaces of the casting rolls each travel toward the nip to produce a cast strip downwardly from the nip.

The electromagnetic beam source may be directed to contact the casting roll surface after contact with the rotating brush and before entry into the casting area where a controlled atmosphere is maintained above the casting pool. The electromagnetic beam source may be directed to contact the casting roll surface adjacent the rotating brush.

The methods may include detecting the specular reflectance, detecting the diffuse reflectance, or both. A signal may be provided to a device selected from the group consisting of a voltmeter, chart recorder and data logger.

The energy of the rotating brush against the casting roll may be controlled by varying the pressure applied by the brush against the casting roll surface of the casting roll, varying the rotation speed of the brush against the casting surface of the casting roll, or by both the applied pressure and the rotation speed. The energy, applied pressure and rotation speed of the rotating brush against the casting roll may be measured by measuring the torque of a motor rotating the brush. The energy may be automatically controlled by automated controls during a casting campaign.

By controlling the degree of cleaning based on reflectance of the roll surface, the same effective cleaning of the casting surfaces can thus be controlled and maintained through the casting campaign. In turn, the cleaning of the casting surfaces can be monitored and controlled indirectly by controlling the energy exerted by the rotating brush against the casting rolls either manually or automatically as explained in detail by example below.

BRIEF DESCRIPTION OF THE DRAWINGS

In order that the invention may be more fully explained, particular embodiments will be described in detail with reference to the accompanying drawings in which.

DETAILED DESCRIPTION OF THE DRAWINGS

Figure 4:
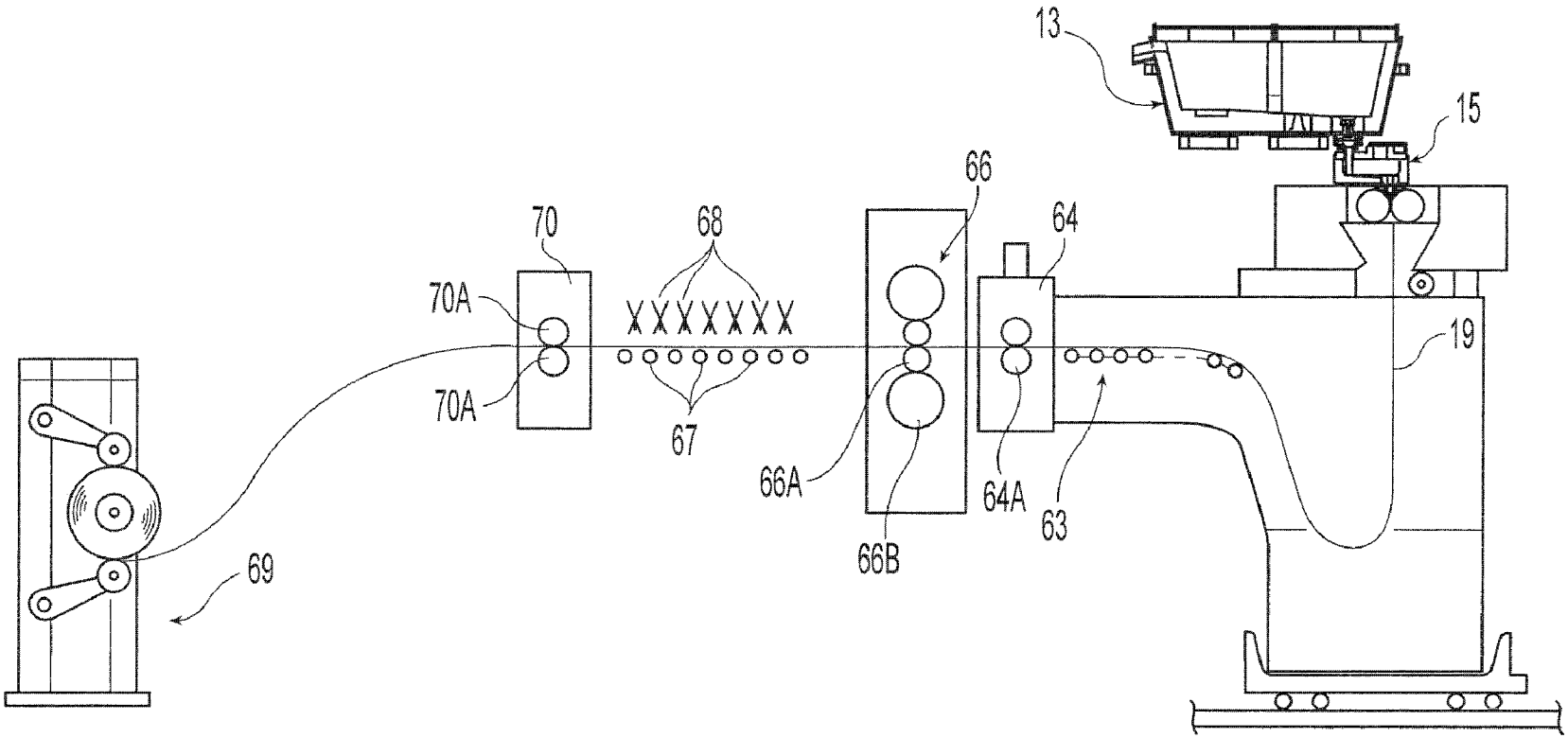
FIG. 4 is a diagrammatic side elevation view of an illustrative strip caster.
Figure 5:
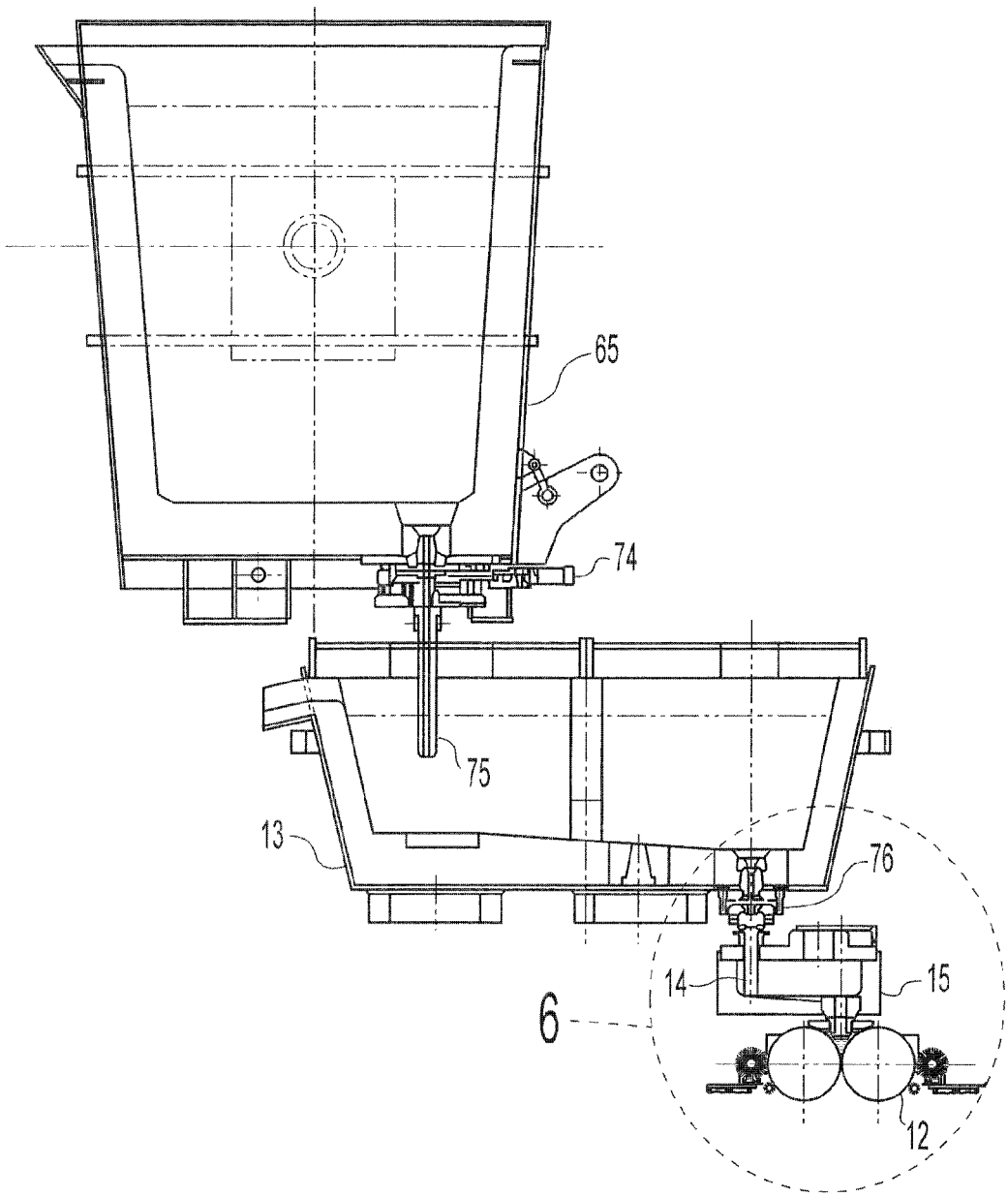
FIG. 5 is a partial side elevation of a portion of the caster of FIG. 4.

The embodiments are described with reference to a twin roll caster in FIGS. 4 through 10. FIG. 4 shows successive parts of an illustrative production line whereby steel strip can be cast in accordance with the present invention. FIGS. 4 and 5 illustrate a twin roll caster that produces a thin cast strip 19 that passes in path across a guide table 63 to a pinch roll stand 64 comprising pinch rolls 64A. Upon exiting the pinch roll stand 64, the thin cast strip may pass through a hot rolling mill 66, comprising a pair of reduction rolls 66A and backing rolls 66B, where the cast strip is hot rolled to reduce to a desired thickness. The rolled strip passes onto a run-out table 67 where it may be cooled by contact with water supplied via water jets 68 (or other suitable means) and by convection and radiation. In any event, the rolled strip may then pass through a pinch roll stand 70 comprising a pair of pinch rolls 70A and thence to a coiler 69.

Figure 6:
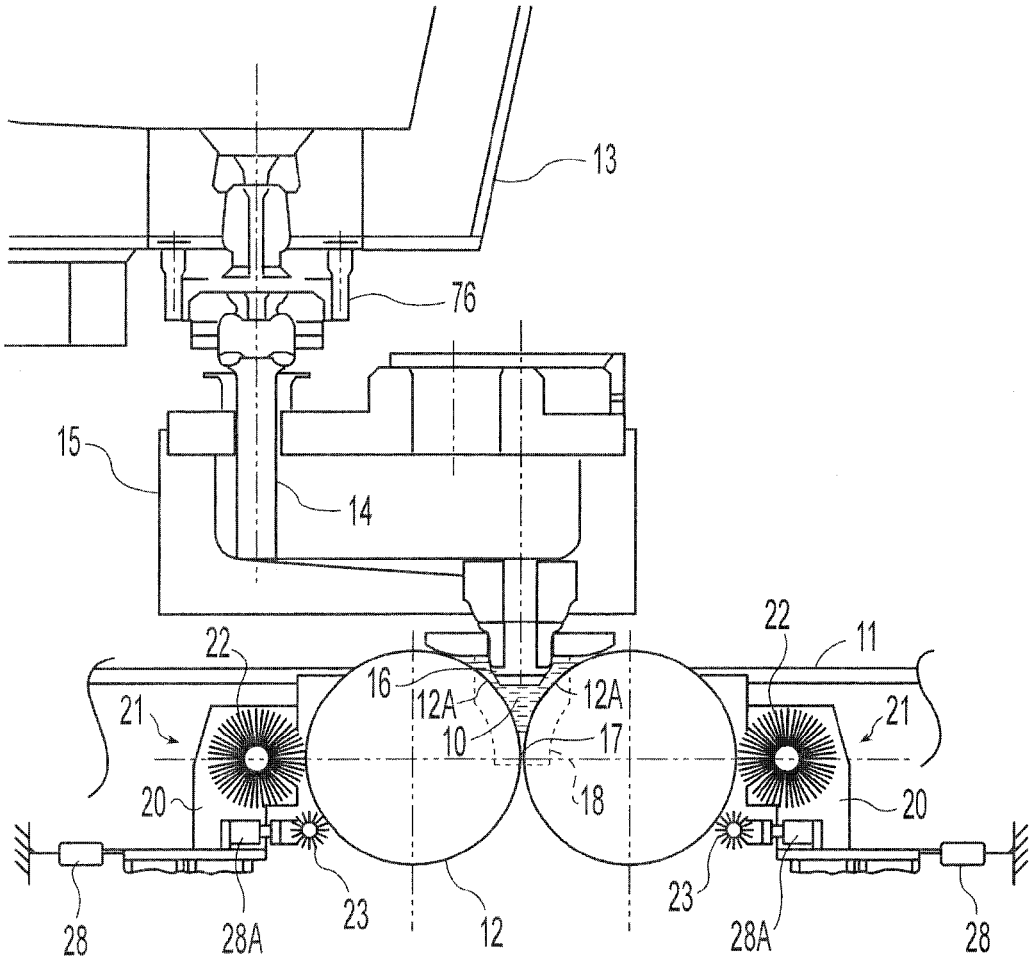
FIG. 6 is an enlarged view taken of the area marked 6 in FIG. 5 illustrating a pair of brushing apparatus in accordance with the invention.

As shown in FIGS. 5 and 6, the twin roll caster comprises a main machine frame 11 that supports a pair of internally cooled casting rolls 12 having casting surfaces 12A, assembled side-by-side with a nip between them. Molten metal of plain carbon steel may be supplied during a casting operation by gravity feed from a ladle 65 to a tundish 13, through a slide gate 74 and refractory shroud 75. From tundish 13, the molten metal is supplied by gravity feed through slide gate 76 and shroud 14 to a distributor 15, and thence through a metal delivery nozzle 16 above the nip 17 between the casting rolls 12. The molten metal thus delivered to the casting rolls 12 forms a casting pool 10 supported on the casting roll surfaces 12A above the nip. The upper surface of casting pool 10 (generally referred to as the "meniscus" level) is designed to be above the lower end of the delivery nozzle 16 so that the lower end of the delivery nozzle is immersed within the casting pool 10 and the molten metal can be delivered with reduced turbulence from the delivery nozzle into the casting pool.

Casting pool 10 is confined at the ends of the casting rolls 12 by a pair of side dam plates 18, which are adjacent to and held against stepped ends of the casting rolls when the roll carriage is at the casting station. Side dam plates 18 are illustratively made of a refractory material, for example boron nitride composite, and generally have scalloped side edges to match the curvature of the stepped ends of the casting rolls. The side plates can be mounted in plate holders that are movable at the casting station by actuation of a pair of hydraulic cylinder units (or other suitable means) to bring the side plates into engagement with the stepped ends of the casting rolls to form end closures for the molten pool of metal formed on the casting rolls during a casting operation.

Frame 11 supports a casting roll carriage (not shown) that is horizontally movable between a mounting station and a casting station. The casting roll carriage supports the casting rolls 12, and is able to move the casting rolls 12 as an assembly from a mounting station to the casting station in the caster.

Casting rolls 12 are internally water cooled so that metal shells solidify on the moving casting surfaces 12A of the casting rolls 12 in the casting pool 10. With counter-rotation of the casting rolls, the shells are then brought together at the nip 17 between the casting rolls to produce the thin cast product 19, which is delivered downwardly from the nip. The casting surfaces may textured, for example, with a random distribution of discrete projections as described and claimed in U.S. application Ser. No. 10/077,391, filed Feb. 15, 2002, and issued as U.S. Pat. No. 7,073,565.

Casting rolls 12 are counter-rotated through drive shafts (not shown) driven by an electric, hydraulic or pneumatic motor and transmission. Each casting roll 12 may have copper peripheral walls adjacent the casting surfaces 12A is generally coated with chromium, or nickel or some other suitable hard coating. Formed in each casting roll 12 is a series of longitudinally extending and circumferentially spaced water cooling passages to supply cooling water. The casting rolls 12 may typically be about 500 millimeters in diameter, and may be up to 1200 millimeters or more in diameter. The casting rolls 12 may be up to about 2000 millimeters, or longer, in order to enable production of strip product of about 2000 millimeters width, or wider, as desired.

Tundish 13 is of conventional construction. It is formed as a wide dish made of a refractory material such as for example magnesium oxide (MgO). One side of the tundish receives molten metal from the ladle. An overflow spout and an emergency plug (not shown) may be provided at the other side if desired.

Delivery nozzle 16 is formed as an elongated body made of a refractory material such as for example alumina graphite or zirconia graphite. Its lower part is tapered so as to converge inwardly and downwardly above the nip between casting rolls 12, and submerged in the casting pool 10. Delivery nozzle 16 may have a series of horizontally spaced, generally vertically extending flow passages to produce a suitably low, generally horizontal discharge of molten metal along the width of the casting rolls and to deliver the molten metal in the casting pool 10 onto the roll surfaces 12A where solidification occurs. The delivery nozzle may be a described in more detail in U.S. Pat. No. 6,012,508, which is incorporated herein by reference.

The twin roll caster may be of the kind illustrated and described in some detail in, for example, U.S. Pat. Nos. 5,184,668; 5,277,243; 5,488,988; and/or 5,934,359; U.S. patent application Ser. No. 10/436,336; and International Patent Application No. PCT/AU93/00593, the disclosures of which are incorporated herein by reference. Reference may be made to those patents for appropriate construction details but forms no part of the present invention.

A pair of roll brushes denoted generally as 21 is disposed adjacent the pair of casting rolls such that they may be brought into contact with the casting surfaces 12A of the casting rolls 12 at opposite sides from nip 17, prior to the casting surfaces 12A entering the controlled atmosphere above the casting pool, and thereafter coming into contact with the molten metal casting pool 10.

Figure 7:
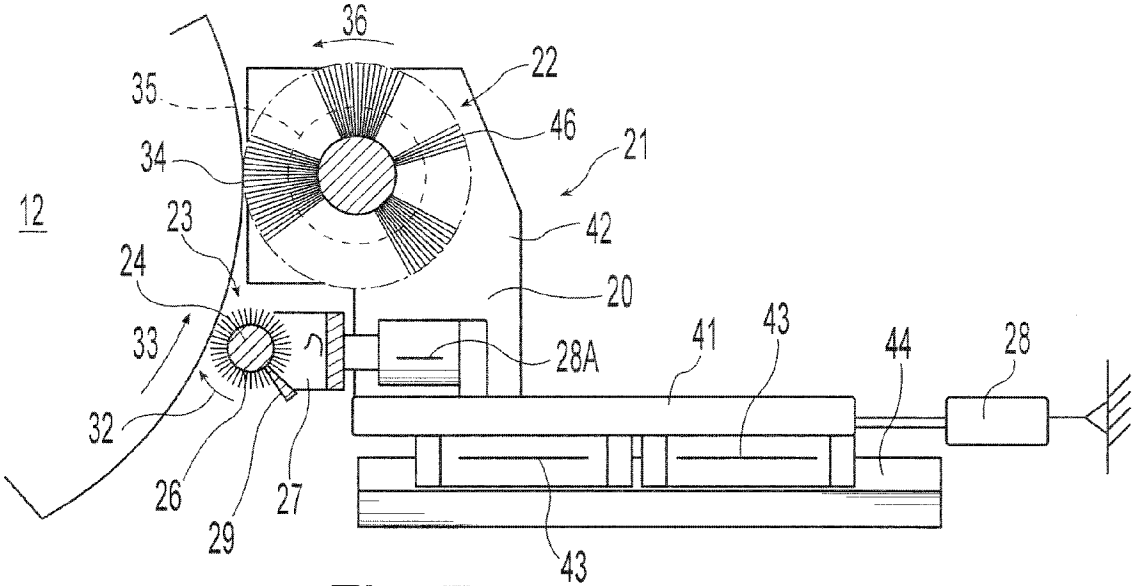
FIG. 7 illustrates one of the brushing apparatus.
Figure 9:
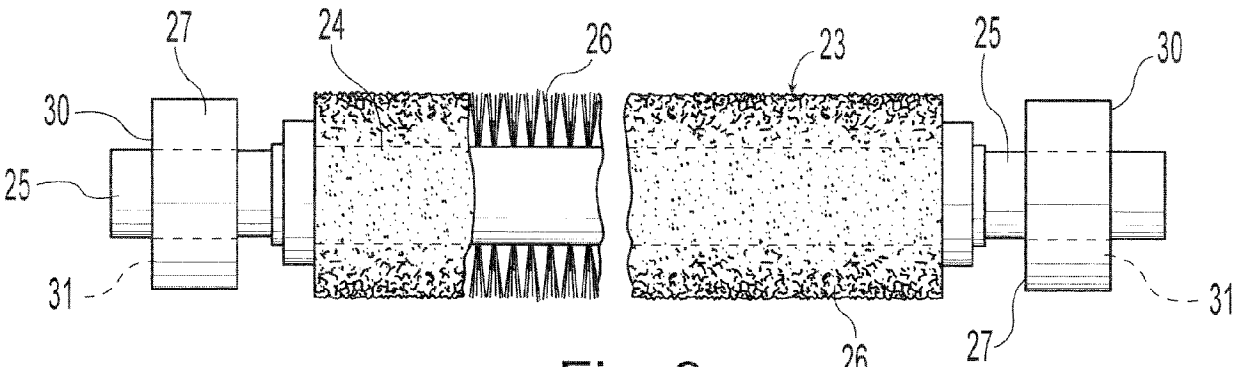
FIG. 9 is a front elevation of a sweeper brush of the brushing apparatus.
Figure 8:
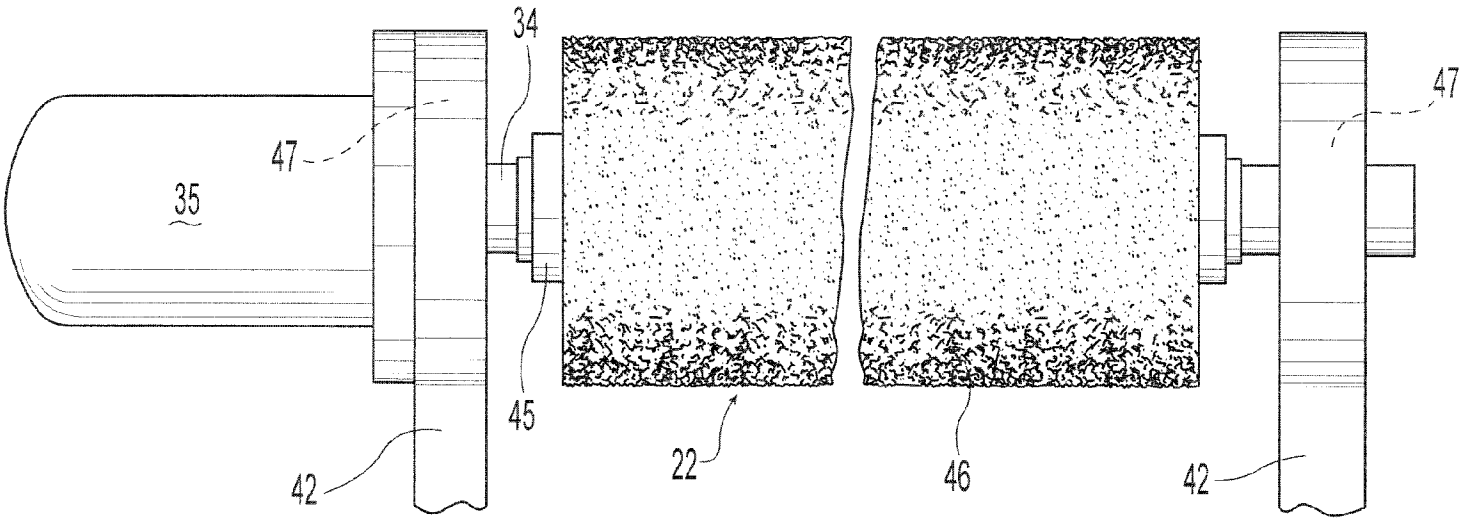
FIG. 8 is a front elevation of a main brush of the brushing apparatus.

FIG. 7 shows the brush apparatus 21, which comprises a brush frame 20 that carries a main cleaning brush 22, for cleaning the casting surfaces 12A of the casting rolls 12 during the casting campaign, and optionally, a separate sweeper brush 23 cleaning the casting surfaces 12A of the casting rolls 12 at the beginning and end of the casting campaign. The main cleaning brush 22 may be segmented, if desired, but is generally one brush extending across the casting roll surface of 12A of each casting roll 12. Frame 20 may comprise a base plate 41 and upstanding side plates 42 on which the main cleaning brush 22 is mounted. Base plate 41 may be fitted with slides 43 which are slidable along a track member 44 to allow the frame 20 to be moved toward and away from one of the casting rolls 12, and thereby move the main cleaning brush 22 mounted on the frame 20 by operation of the main brush actuator 28. A sweeper brush 23, if present, may be mounted on frame 20 to move independently of the main cleaning brush 22 by operation of sweeper brush actuator 28A from retracted positions to operative positions in contact with the casting surfaces 12A of the casting rolls 12, so that either the sweeper brush 23 or the main cleaning brush 22, or both, may be brushing the casting surfaces of the casting rolls without interruption in the brushing operation.

The energy exerted by the main cleaning brush 22 against the casting surfaces 12A of the casting rolls 12 is controlled so that the cleaning of the casting roll surfaces is controlled to a specified level during the casting campaign as described below, and in turn formation of crocodile skin roughness on the thin cast strip is controlled. The energy exerted by the brush on the casting surface 12A may be controlled by controlling the pressure of the brush on the casting rolls, or the rotational speed of the main cleaning brush 22, or both. This pressure and rotational speed will be varied according to the casting speed during the casting campaign.

Figure 1:
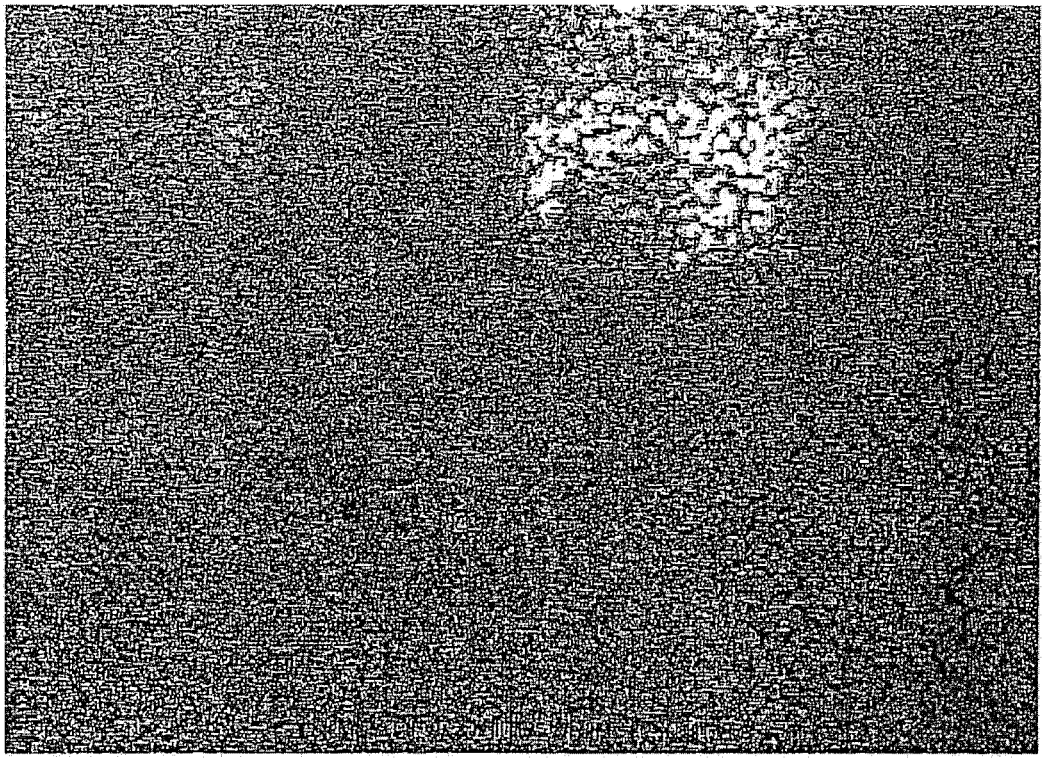
FIG. 1 is a micrograph showing crocodile skin surface roughness controlled by the present invention.
Figure 2:
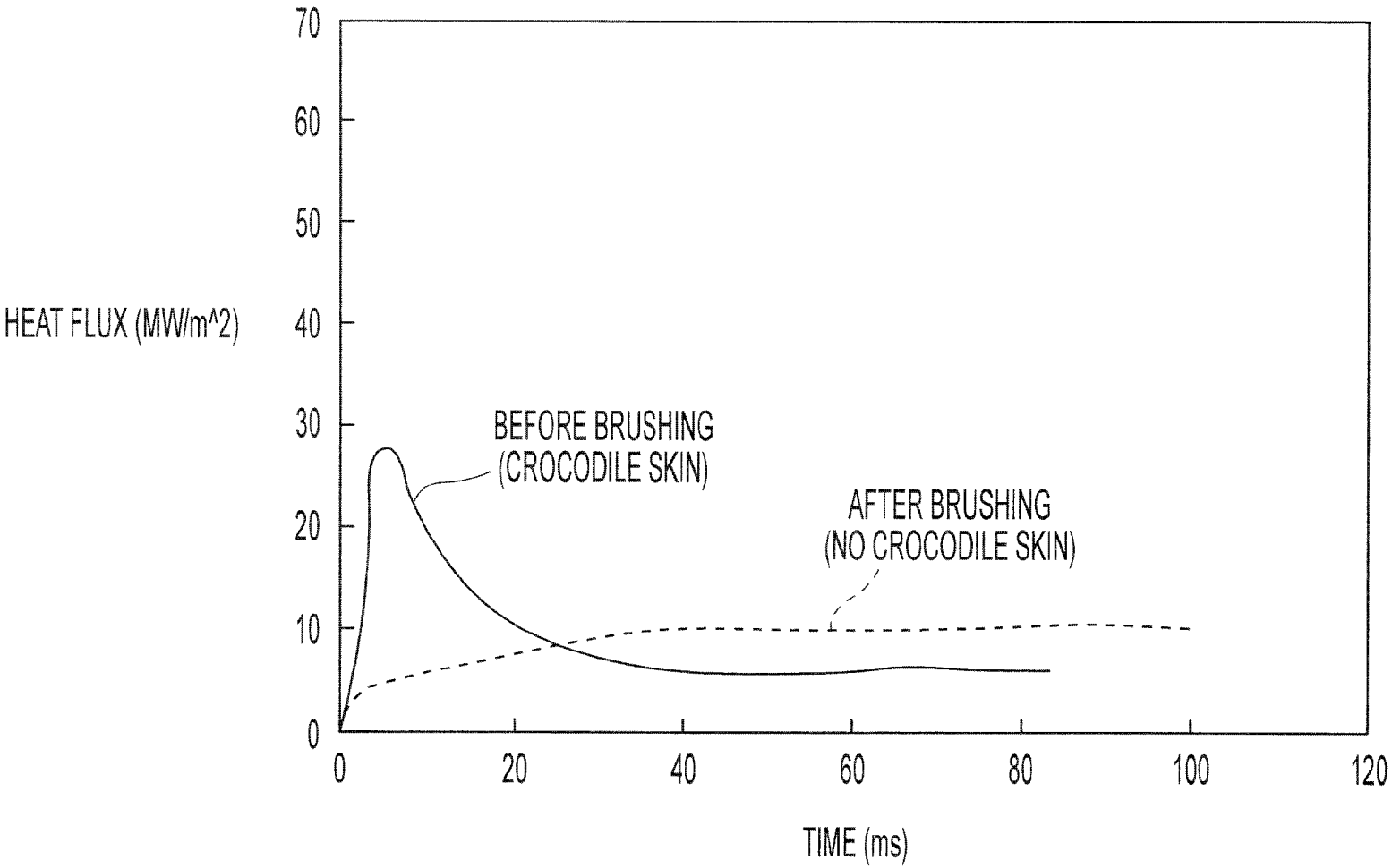
FIG. 2 is a graph illustrating the relationship between controlling heat flux and controlling the formation of crocodile skin surface roughness.
Figure 3:
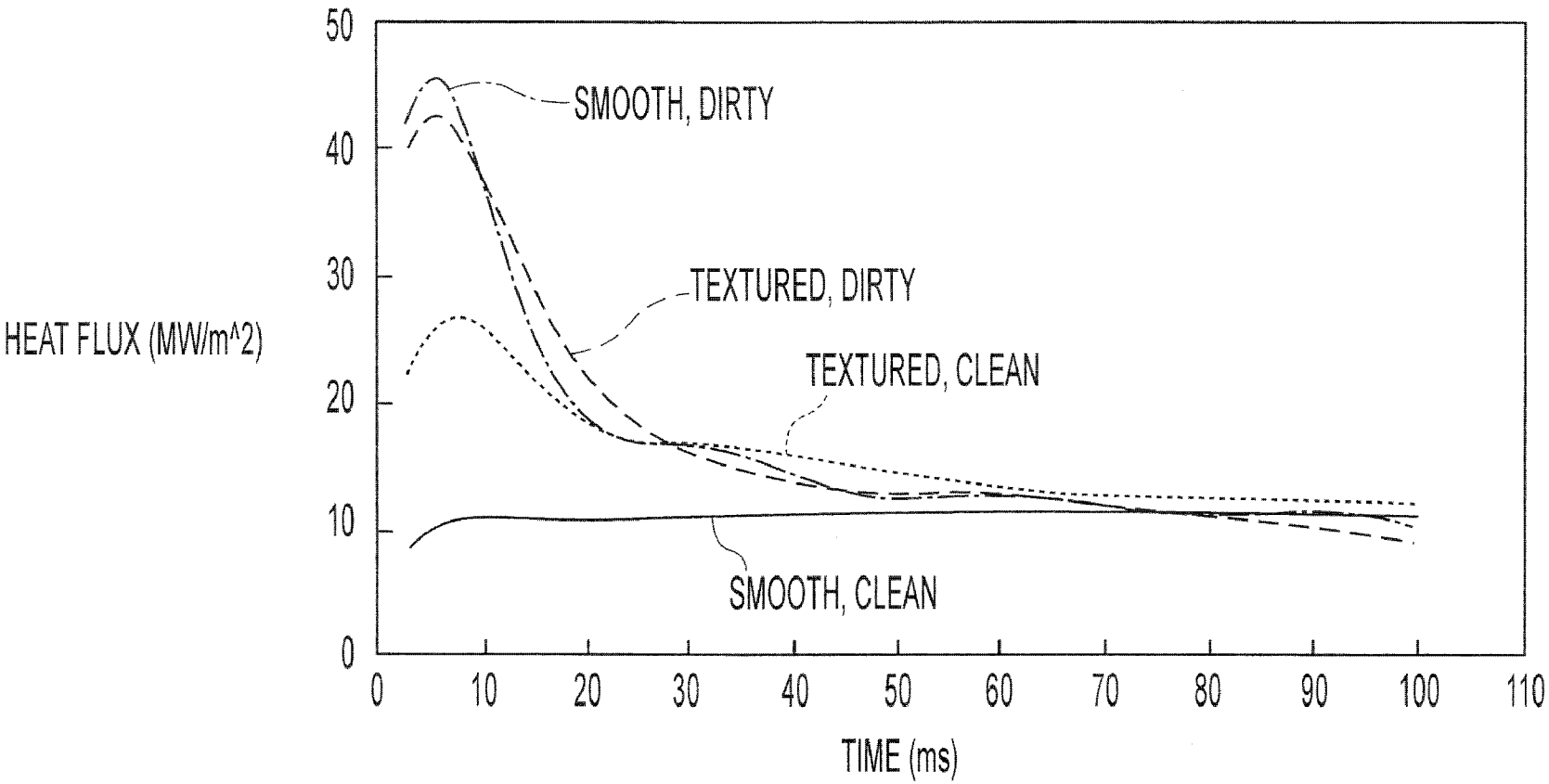
FIG. 3 is a graph illustrating the relationship between controlling heat flux and controlling the formation of crocodile skin surface roughness with smooth and textured casting roll surfaces.

We have found that the detected reflectance of the casting roll surface 12A changes depending upon the surface condition of the casting roll, and more importantly the degree of cleaning of the casting roll surfaces. For example, as the degree of cleaning reduces or decreases, the roll surface 12A may become more black and less reflective. As shown in FIGS. 2 and 3, crocodile skin formation increases as the degree of cleaning decreases.

The method of controlling crocodile skin formation may include a control system responsive to changes in the reflectance of the casting roll surface 12A, or in the reflectance of the surface of the thin cast product 19. The degree of cleaning of the casting surfaces of the casting rolls may be monitored and controlled based on the detected reflectance from the casting surface of the casting roll. The control system may be automated.

Figure 11:
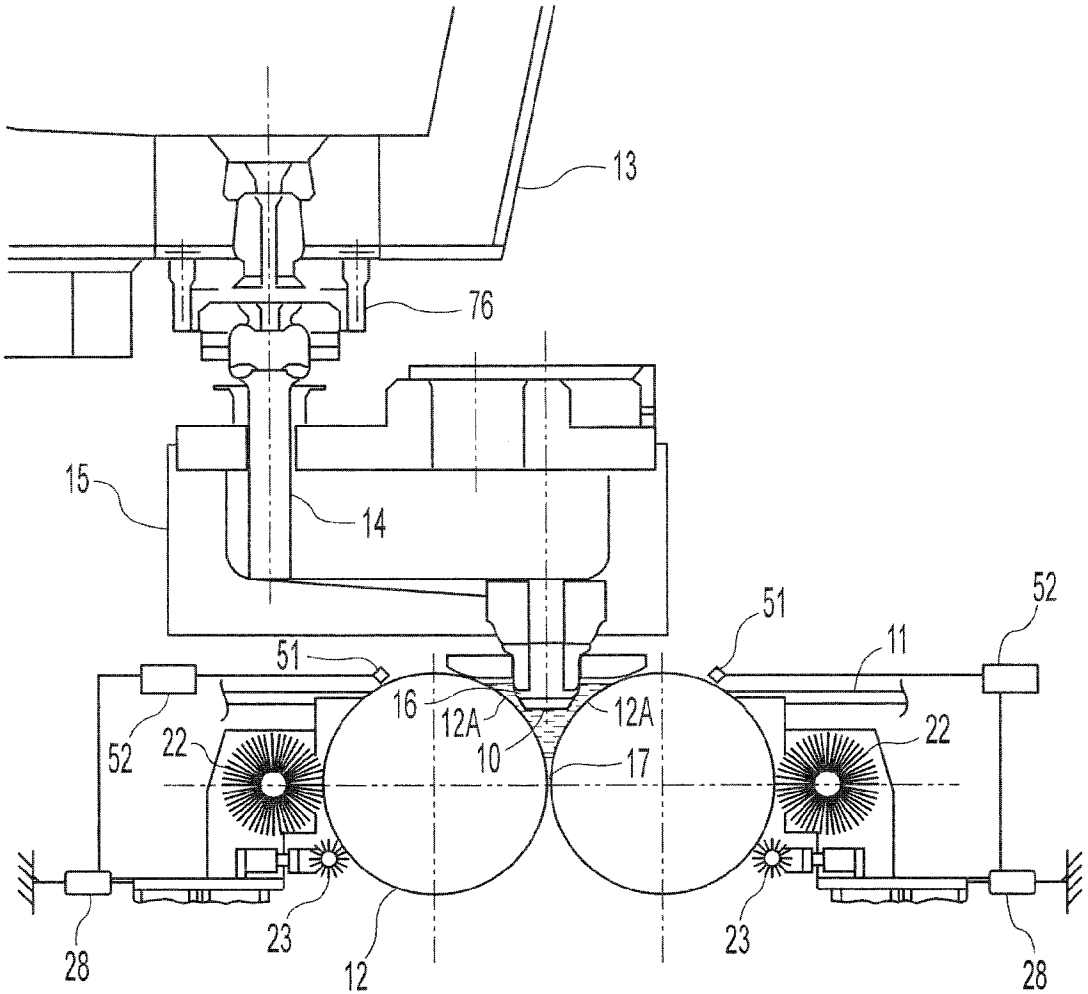
FIG. 11 illustrates the twin roll caster incorporating an optical inspection device positioned for monitoring the casting surfaces of the casting rolls.

FIG. 11 diagrammatically illustrates a cleaning and monitoring apparatus for a twin roll caster incorporating an optical inspection device 51 and a controller 52 positioned for monitoring the casting roll surface 12A. The control system may monitor the degree of cleaning of the casting surfaces of the casting rolls based on the detected reflectance from the casting surface of the casting rolls and control the degree of cleaning by maintaining substantially stable the detected level of reflectance of an electromagnetic beam source from the casting roll surfaces, and in turn maintaining substantially stable the degree of cleaning of the casting rolls surfaces.

The electromagnetic beam source may direct an electromagnetic beam to contact the casting roll surface after contact with the rotating brush and before entry into the casting area where a controlled atmosphere is maintained above the casting pool. The electromagnetic beam source may be directed toward the casting roll surface adjacent the rotating brush.

Figure 12:
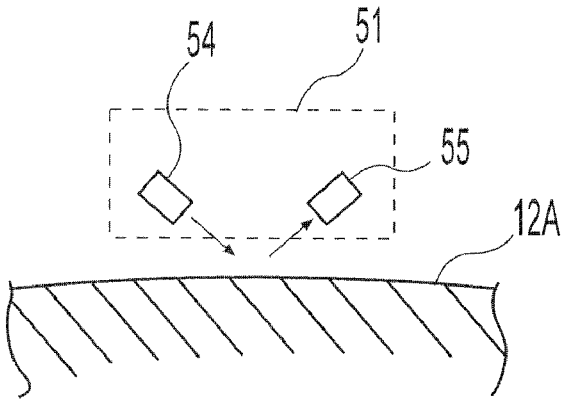
FIG. 12 is a diagrammatical side elevation of a light emitter and receiver of the optical inspection device positioned above a casting roll surface.

As shown in FIG. 12, the inspection device 51 may include an electromagnetic beam source such as a light emitter 54, positioned a distance from the roll surface, and a detector 55 may be positioned to detect light reflected from the surface of the roll. The light emitter 54 may provide an electromagnetic beam, such as but not limited to visible or infrared light, to be reflected from the surface, the reflectance detected by the detector 55. The inspection device 51 may be directed toward an upper part of the roll surface above the brushes 22 in order to measure the reflectance of the roll surface 12A adjacent where the brushes have passed over the roll surface 12A, and hence measure the degree of cleaning.

When positioned to measure and monitor the casting roll surface 12A, the inspection device 51 may direct an electromagnetic beam from the light emitter 54 toward the casting roll surface 12A. The detector 55 may detect the reflectance from the casting roll surface of the electromagnetic beam, such as but not limited to visible or infrared light, from the light emitter 54 and generate a signal corresponding to the detected reflectance from the surface and corresponding to the degree of cleaning of the casting surfaces.

Alternately, the reflectance from the roughness of the thin cast product 19 may be monitored. The reflectance of the thin cast product 19 changes depending upon the size and character of imperfections on the surface of the cast product, and the imperfections may increase as the degree of cleaning of the casting surfaces of the casting rolls 12A decrease. Particularly, crocodile skin roughness may increase across the cast surface as the degree of cleaning of the casting surface 12A decreases, causing the detected reflectance from the roughness of the surface of the thin cast product 19 to change. In this way, the control system may monitor the degree of cleaning of the casting surfaces of the casting rolls based on the detected reflectance from the surface of the thin cast product 19.

Figure 14:
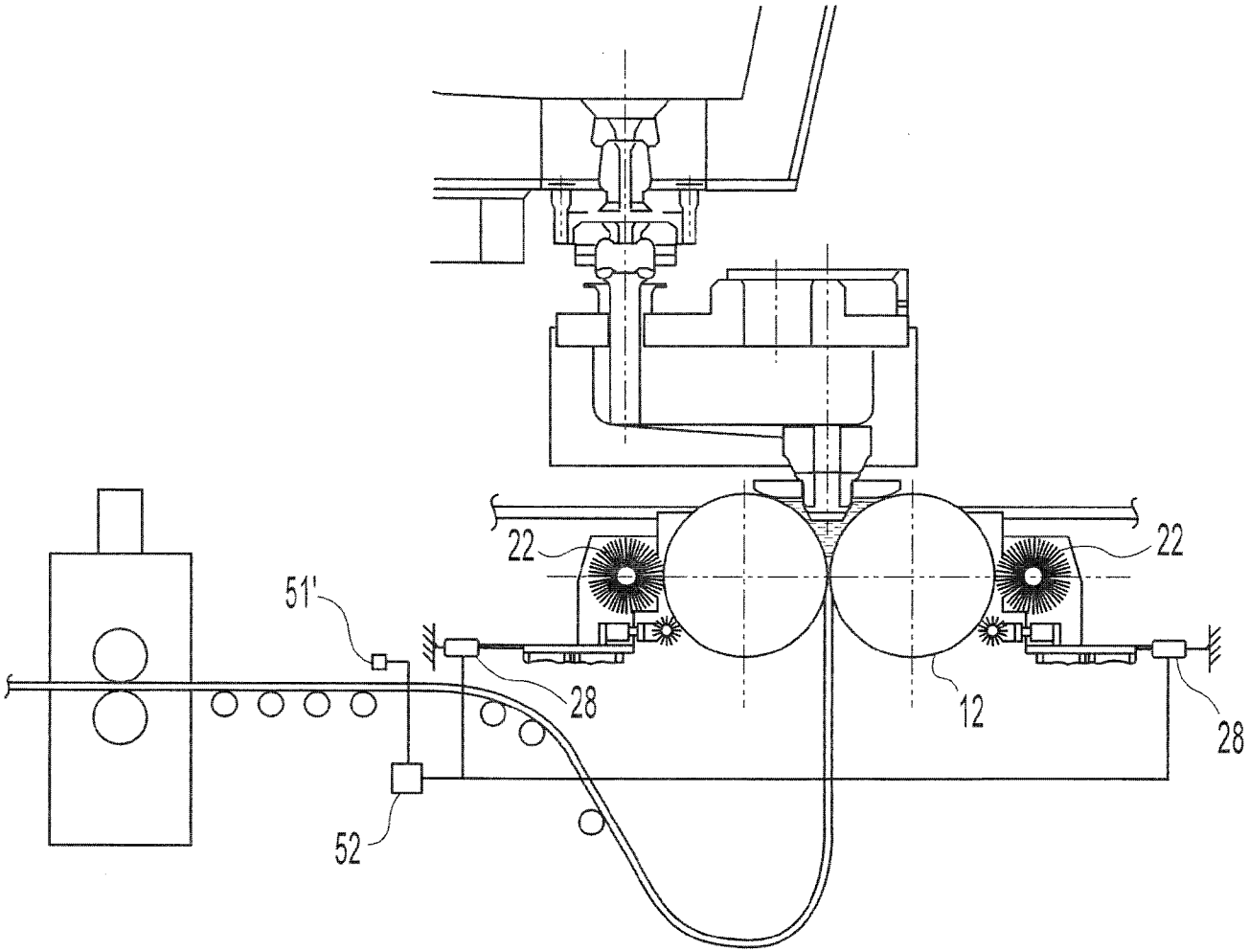
FIG. 14 illustrates the twin roll caster incorporating the optical inspection device positioned for monitoring the surface of the thin cast product before the pinch roll stand.
Figure 15:
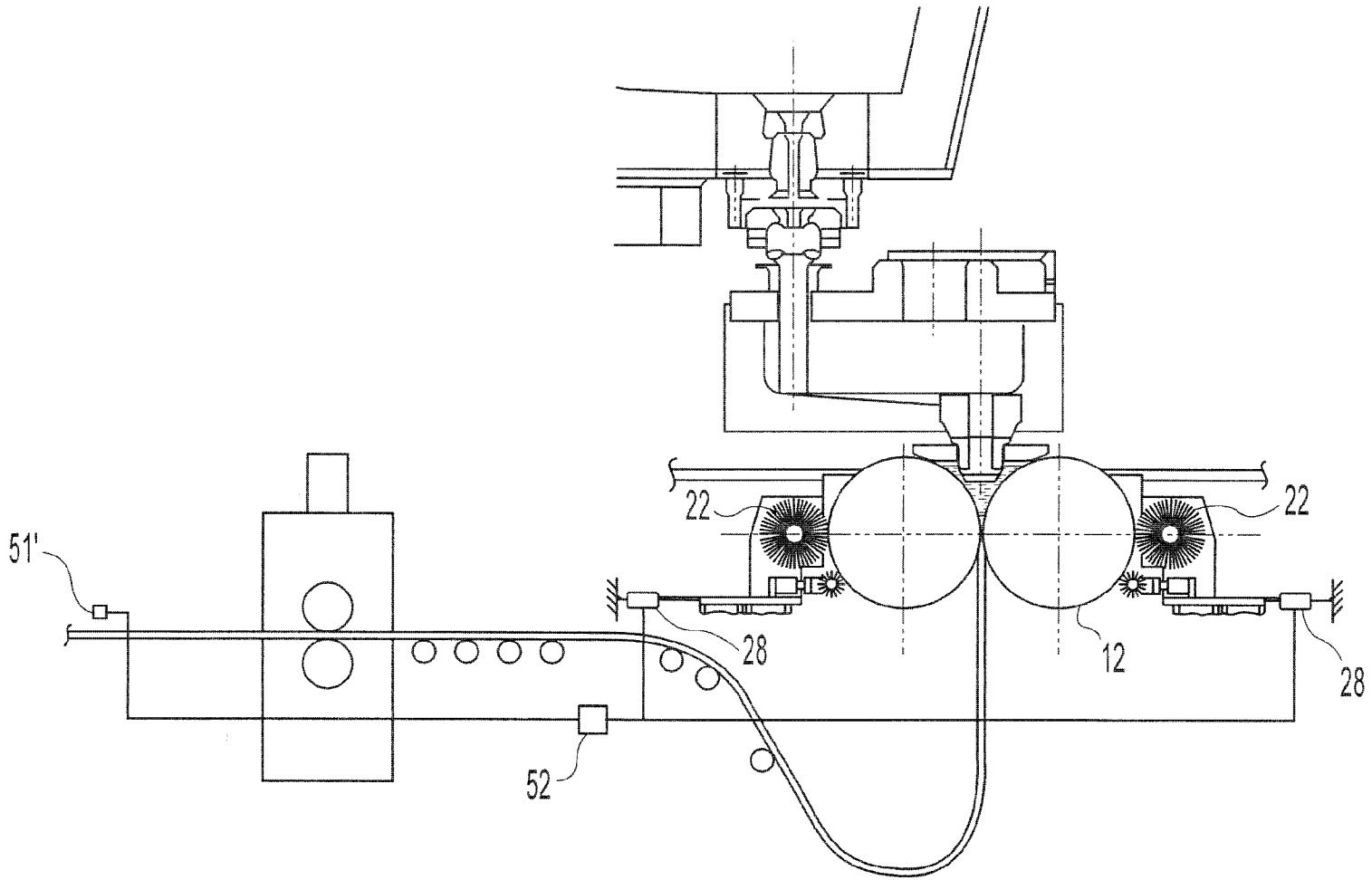
FIG. 15 illustrates the twin roll caster incorporating the optical inspection device positioned for monitoring the surface of the thin cast product after the pinch roll stand.

FIGS. 14 and 15 diagrammatically illustrate a twin roll caster incorporating the optical inspection device 51' positioned to measure and monitor the surface of the thin cast product 19. The optical inspection device 51' may be positioned to measure the surface of the thin cast product 19 before the cast product passes through the pinch roll stand 64 as shown in FIG. 14. Alternately, the optical inspection device 51' may be positioned to measure the surface roughness of the thin cast product 19 after the cast product passes through the pinch roll stand 64 as shown in FIG. 15. The optical inspection device 51' may be positioned to measure the detected reflectance from the surface of the thin cast product 19 in any desired location.

Figure 16:
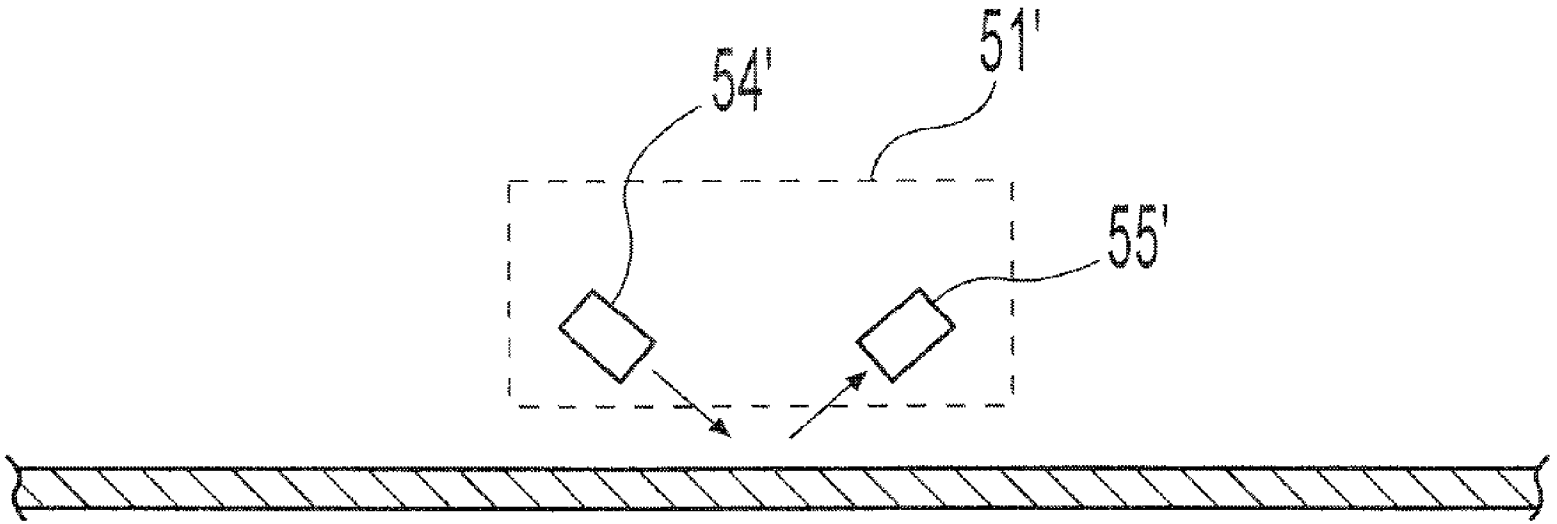
FIG. 16 is a diagrammatical side elevation of the light emitter and receiver of the optical inspection device positioned above a thin cast product.

As shown in FIG. 16, the inspection device 51' may include the light emitter 54', positioned a distance from the thin cast strip 19, and detector 55' may be positioned to detect the electromagnetic beam reflectance from the surface of the thin cast product 19. The inspection device 51' may direct the electromagnetic beam, such as but not limited to visible or infrared light, from the light emitter 54 toward the surface of the thin cast product 19. The detector 55' may detect the reflectance of the electromagnetic beam from the emitter 54' off of the surface and generate an electrical signal corresponding to the detected reflectance from the surface, corresponding to the roughness of the surface and the degree of cleaning of the casting surfaces.

In our testing, an inspection device 51, 51' was operated a stand-off distance of 5 millimeters from the monitored surface. The inspection device 51, 51' may be arranged with the light emitter 54, 54' and the detector 55, 55' positioned in the same plane, with the axes of the devices arranged at desired angles either side of a line normal to the monitored surface as indicated by FIGS. 12 and 16. For some monitored surfaces, such as textured surfaces, this orientation makes a portion of the reflected light from the strip surface or the casting roll surface to be specular reflectance, and a portion of the reflected light to be diffuse reflectance. The distance from the monitored surface and the orientation of the light emitter 54, 54' and detector 55, 55' may be changed to provide a desired intensity of specular reflectance and diffuse reflectance from the surface detected by the detector 55, 55'.

The light emitter 54, 54' may include a source of an electromagnetic beam, such as but not limited to an infrared Light Emitting Diode (LED). The light emitter 54, 54' may provide an electromagnetic beam having a wavelength of between about 400 and about 1200 nanometers. Alternately, the electromagnetic beam may be an ultraviolet beam having a wavelength less than about 400 nanometers. Or, the electromagnetic beam may be an infrared beam of greater than about 1200 nanometers. The light emitter 54, 54' may include a 935 nanometer wavelength infrared LED, although LEDs of other wavelengths may be used, as well as other desired light sources, such as, but not limited to, incandescent lamps and lasers. The inspection device 51, 51' may include more than one light emitter 54, 54'. Further, the inspection device 51, 51' may include more than one detector 55, 55'. In a twin roll caster the casting rolls may be of the order of 2,000 millimeters wide. Multiple inspection devices 51, 51' may be positioned to inspect across the width of the roll or cast product. Alternately, one or more inspection devices 51, 51' may be used to measure the reflectance of a representative portion of the roll surface 12A or thin cast product 19.

The output signal of the detector 55, 55' corresponding to the beam reflectance from the surface may be received and monitored using a voltmeter, chart recorder, data logger, or other instrument for monitoring the output signals. The reflected light from the monitored surface and thus the detector output signal changes depending upon the surface condition of the casting rolls, or the degree of cleaning. To use the output signal as a measure of cleanliness, the output from the detector 55, 55' may be compared to a control such as an output generated by reflectance of the monitored casting surface at the beginning of the casting campaign, or a control output from a electromagnetic beam reflected from a known reflective surface, such as by a gray scale calibration.

Figure 13:
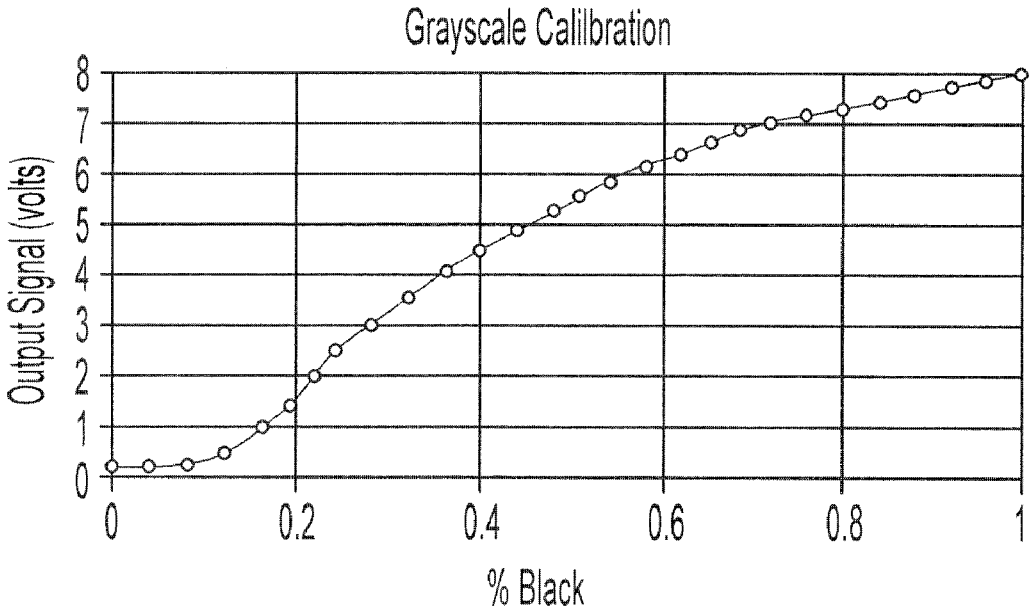
FIG. 13 is a plot of percent blackness relative to a gray scale calibration.

The output signal shown in FIG. 13 is one example of an output signal voltage from the detector 55, 55', where the voltage increases as the degree of cleaning reduces or decreases. The y-axis in FIG. 13 shows the output signal, which in this test was an output voltage. The x-axis in FIG. 13 shows a degree of blackness relative to a gray scale calibration, where 0 percent black has a high reflectance and 100 percent black has a low reflectance.

The controller 52 may be programmed to monitor the output signal of the detector 55, 55' and provide a signal to alert an operator. Alternately, the controller 52 may be used to automatically control the rotating main cleaning brush 22 when the output of the detector 55, 55' is not within a desired range. The controller 52 may automatically control the degree of cleaning of the casting surfaces 12A based on the electromagnetic beam reflected from the casting roll surfaces 12A or from the surface of the thin cast product 19 by comparing the measured reflectance to a desired amount of reflectance. For example, the desired range for the output signal from the detector 55, 55' may be within the range of 0.2 to 4 volts, to correspond to a range of approximately 0 to 0.35 on the gray scale calibration shown as an example in FIG. 13. The desired output range may be determined by making reflectance measurements of the roll surface 12A or the surface of the thin cast product 19 after a desired degree of cleaning to expose a majority of projections of the casting surfaces of the casting roll. The controller 52 may have a hard-wired control circuit or it may incorporate appropriate software controls.

The controller 52 may control the degree of cleaning by controlling the energy exerted by the rotating main cleaning brush 22 against the casting surfaces 12A of the casting rolls 12 based on the degree of cleaning to expose a majority of projections of the casting surfaces of the casting rolls and provide wetting contact between the casting surface and the molten metal of the casting pool. The output signal from the detector 55, 55' may be fed to the controller 52, which may control the operation of the brush actuator 28. In this way, the controller 52 may automatically control the effectiveness of the cleaning of the roll by monitoring the reflectance from the casting roll surfaces 12A or the surface of the thin cast product 19, or both, and monitoring and controlling the energy exerted by the rotating brushes. For example, if the controller measures a change in reflectance measured by the detector 55, 55' indicating a lesser degree of cleaning, the controller 52 may increase the degree of cleaning by increasing the energy exerted by the main cleaning brush 22 against the casting surface 12A. As discussed above, the energy exerted by the main cleaning brush 22 against the casting surface 12A of the casting roll 12 may be controlled by controlling the applied pressure or the speed of rotation, or both, of the motor rotating the brush 22. The energy, pressure or rotation speed of the rotating brush can be monitored by measuring the torque of the motor rotating the brush 22.

The method of controlling the formation of crocodile skin surface roughness may include the steps of directing an electromagnetic beam toward the surface of thin cast strip following discharge from casting surfaces of a twin roll caster, detecting reflectance of the electromagnetic beam by the casting surfaces of the thin cast strip, processing the reflectance by the casting surfaces of the thin cast strip to measure the degree of roughness of the surface of the thin cast strip, and based on the measured degree of roughness, controlling the degree of cleaning of the casting surfaces by controlling energy exerted by brushes against the casting surfaces of the twin roll caster to control crocodile skin roughness of the thin cast strip.

Alternately, the method of controlling the formation of crocodile skin surface roughness may include the steps of directing at least one light source toward at least one of the casting roll surfaces, detecting the reflectance of light from the casting roll surface directed to the surface from the light source and generating an electronic signal corresponding to the reflected light from the casting surface, monitoring the degree of cleaning of the casting surfaces of the casting rolls based on the detected light reflected from the casting surface of the casting rolls, and controlling the energy exerted by the rotating brushes against the casting surfaces of the casting rolls based on the monitored degree of cleaning to expose a majority of projections of the casting surfaces of the casting rolls and provide wetting contact between the casting surface and the molten metal of the casting pool.

In yet another alternative, the method of controlling the formation of crocodile skin surface roughness may monitor the degree of cleaning of the casting surfaces of the casting rolls based on changes in the heat flux through the casting rolls 12. In this method, the initial measured heat flux is related to the desired degree of cleaning of the casting roll surfaces 12A, as above described, to control the formation of crocodile skin roughness during the casting campaign. The continual measured heat flux in real time, and the difference between the initial heat flux and the real time heat flux measured, is used to control the energy exerted by the cleaning brush on the casting surfaces 12A so that cleaning of the casting roll surfaces 12A is controlled, and in turn, the formation of crocodile skin roughness on the surface of the cast strip controlled. The control of the energy exerted by the brushes on the casting surface to control the formation of crocodile skin roughness can be performed by automated controls controlling the hydraulic fluid flow through the hydraulic motors based on changes in the heat flux.

In any case, the method may be practiced by controlling the energy exerted by the rotating brush to maintain the casting surfaces 12A of the casting rolls 12 clean, as described below, during the casting campaign. This may be done by cleaning to expose a majority of the projections of the casting surfaces of the casting rolls 12. What is important is that the energy exerted by the cleaning brush against the casting surfaces is capable of being controlled so the cleaning of exposed casting surface of the casting rolls 12 is controlled throughout the casting campaign as described below, and in turn, formation of crocodile skin surface roughness of the cast strip is controlled. The energy exerted by main cleaning brush 22 against the casting surface 12A of the casting roll 12 may be controlled by controlling the application pressure, the speed of rotation, the torque, or a combination thereof, of an electric, pneumatic or hydraulic motor rotating the brush coordinated with the casting speed. The energy, pressure or rotation speed of the rotating brush can be measured by measuring the torque of the motor rotating the brush.

The main cleaning brush 22 may be in the form of a cylindrical barrel brush having a central body 45 carried on a shaft 34 and fitted with a cylindrical canopy of wire bristles 46. Shaft 34 may be rotatably mounted in bearings 47 in the side plates 42 of frame 20, and a hydraulic, pneumatic, or electric drive motor 35 may be mounted on one of these side plates coupled to the brush shaft 34 so as to rotatably drive the main cleaning brush 22 in the opposite direction of the rotation of the casting surfaces 12A of casting roll 12. Although the main cleaning brush 22 is shown as a cylindrical barrel brush, it should be understood that this brush may take other forms such as the elongate rectangular brush disclosed in U.S. Pat. No. 5,307,861, the rotary brushing devices disclosed in U.S. Pat. No. 5,575,327 or the pivoting brushes of Australian Patent Application No. P07602. The precise form of the main brush is not important to the present invention.

The rotational speed of the main cleaning brush 22 can be measured, for example, by a flow meter measuring the flow of hydraulic fluid through a hydraulic motor driving the rotating main cleaning brush 22. The torque of the motor may be monitored by measuring the pressure differential between inlet and outlet of hydraulic fluid through the hydraulic motors. Alternatively, the torque of the motors, hydraulic, electric or pneumatic, may be monitored by measuring the torque with a strain gauge, load cell or other device between the hydraulic motor and mount for bearings 47 (i.e., chock) or other convenient part of the motor mount structure.

Alternatively, the torque of the brush motor driving rotation of the main cleaning brush 22 and in turn the energy exerted by the main cleaning brush 22 against the respective casting surface of casting rolls 12 could be measured by strain gauges, load cell, or other device positioned adjacent the cleaning brush mounting structure or mounts for bearings 47 to measure the torque exerted by the main cleaning brush 22 against the casting surfaces on the casting rolls.

Although the main cleaning brush 22 may be driven in a direction counter to the rotation of the casting roll, the main cleaning brush 22 is usually driven in the same rotational direction 33 as the casting rolls, as indicated by the arrow 36 in FIG. 7. Note that this means that the casting surface 12A is moving in a direction opposite to the movement of the bristles of the brush 22 against the casting surface of the casting roll.

If used, the separate sweeper brush 23, which is peripherally involved in use of the best mode of the invention contemplated, may be in a form of a cylindrical barrel brush which is mounted on frame 20 so as to be moveable on the frame such that it can be brought into engagement with the casting surface 12A of casting roll 12, or retracted away from that the casting surface 12A by operation of the sweeper brush actuator 28A independent of whether the main cleaning brush 22 is engaged with the casting surfaces 12A of casting roll 12. This enables the sweeper brush 23 to be moved independently of the main cleaning brush 22 and brought into operation only during the start and finish of a casting run and be withdrawn during normal casting as described below. The sweeper brush 23 may be rotatably driven in tandem with or independently of the main cleaning brush 22. The sweeper brush 23 may also be driven in the same direction as the casting surfaces 12A of casting rolls 12 at a speed different from the speed of the casting rolls 12. In this way, the large accretions that can occur at the start and end of the casting run are less likely to be dragged across the casting surfaces 12A and cause scoring of the casting surfaces 12A, where the sweeper brush 23 is contacting the casting surfaces 12A and moving in the direction opposite the casting surface.

If used, sweeper brush 23 may have a central body 24 carried on a shaft 25 and fitted with a cylindrical canopy of wire bristles 26. The brush shaft 25 may be rotatably mounted in a brush mounting structure 27 which can be moved back and forth by operation of quick acting hydraulic cylinders 28 to move the sweeper brush 23 inwardly against the casting roll 12 or to retract it away from the casting roll 12. The brush mounting structure 27 may be in the form of a wide yoke with side wings 30 in which the brush shaft 25 is rotatably mounted in bearings 31. The sweeper brush 23, brush mounting structure 27 and actuator 28 may be carried on the brush frame 20 of the brush apparatus 21 so that the sweeper brush 23 will always be correctly positioned in advance of the main cleaning brush 22. The brush mounting structure 27 may also carry an elongate scraper blade 29 which extends throughout the width of the sweeper brush 23 and projects into the canopy of bristles 26. The scraper blade 29 may be made of hardened steel and have a sharp leading edge.

Figure 10:
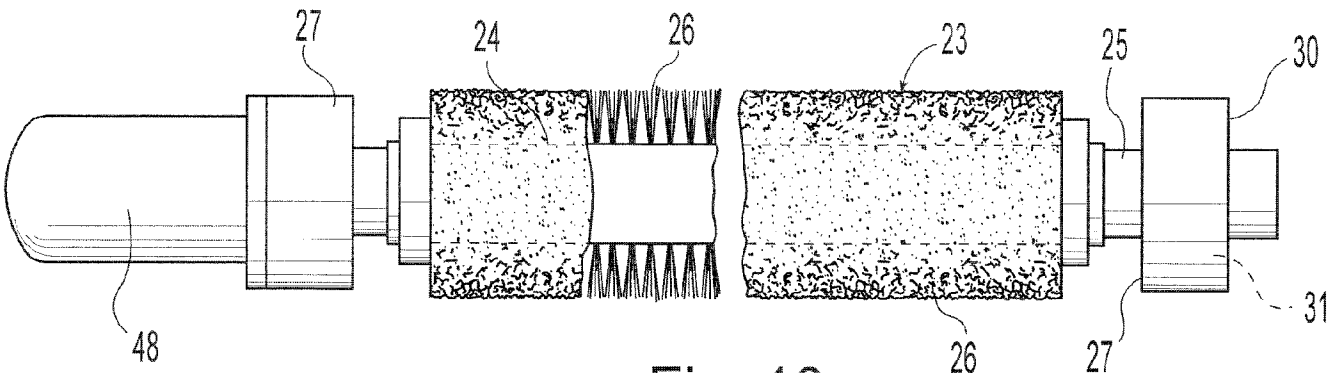
FIG. 10 is a front elevation of the sweeper brush in a modified apparatus in which the sweeper brush is positively driven by a drive motor.

Sweeper brush 23 may be rotated purely by frictional engagement between its canopy of bristles 26 with the casting roll 12, in which case it may be simply rotatably mounted between the side plates 42 of frame 20 without any drive to drive rotation as shown in FIG. 6. However, typically, the sweeper brush 23, if used, is positively driven by provision of a pneumatic, electric or hydraulic drive motor 48 as shown in FIG. 10.

With the arrangement shown in FIG. 7, sweeper brush 23 is biased inwardly against the casting roll 12 by actuation of the cylinder units 28 such that it is rotatably driven by the frictional engagement between the canopy of bristles 26 and the roll surface so that it is rotated in the opposite rotational (same peripheral) direction at the casting surface 12A at the region of its engagement with the casting surface, as indicated by the arrows 32, 33 in FIG. 7. The rotation of the sweeper brush 23 may be retarded by its inter-engagement with the scraper blade 29 so that the sweeper brush 23 is driven at a slower peripheral speed than casting roll 12. The relative speed between the roll and the sweeper brush 23 may cause effective sweeping action and ensure that the bristles engaging the casting roll will change continuously. The scraper blade 29 cleans the sweeper brush 23 of contaminating material swept from the casting surface 12A of the casting roll 12 so that clean bristles are continuously presented to the casting roll 12 surface. A sweeper brush drive motor 48 may be provided as shown in FIG. 10, so that sweeper brush 23 can be positively driven at a fixed speed independent of the speed of the casting roll 12. It will generally be driven so that its bristles travel in the same rotational direction as the surface of the roll 12 but at a different (higher or lower) speed. The rotational speed of the sweeper brush 23 can be varied to optimize this speed differential.

Sweeper brush 23 is moved into contact with the casting surfaces 12A of the casting roll 12 prior to the start of casting and is moved away from the casting surfaces after casting conditions have stabilized. It is moved back into engagement with the casting surfaces just prior to termination of the cast. The point at which the casting conditions stabilize, and sweeper brush 23 is disengaged from the casting surfaces, is usually about when the set point is reached for the level of the pool 10 of molten metal, and the point at which the sweeper brush 23 reengages is usually about when the set point level of the pool 10 is about to drop as the end of the casting run approaches. The sweeper brush 23 serves to prevent damage to the main cleaning brush 22 and the casting surface 12A of casting roll 12 due to carry over of debris generated on commencement and near termination of the casting run.

Figure 17:
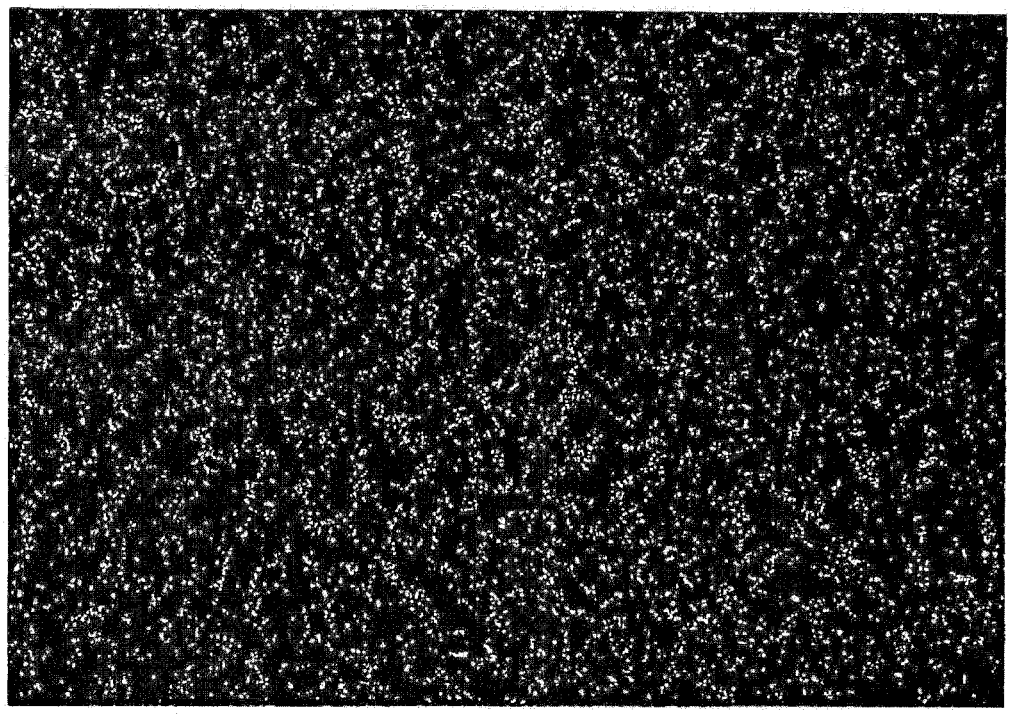
FIGS. 17 through 19 are micrographs showing textured casting roll surfaces cleaned in accordance with the present invention with the projections of the casting roll showing.
Figure 18:
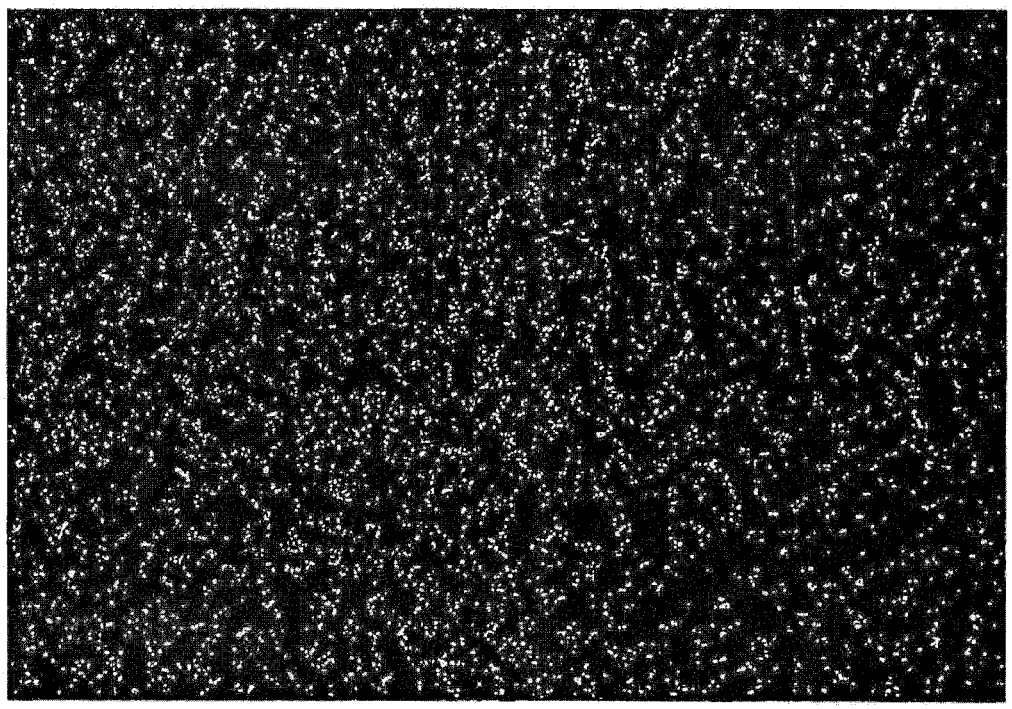
Figure 19:
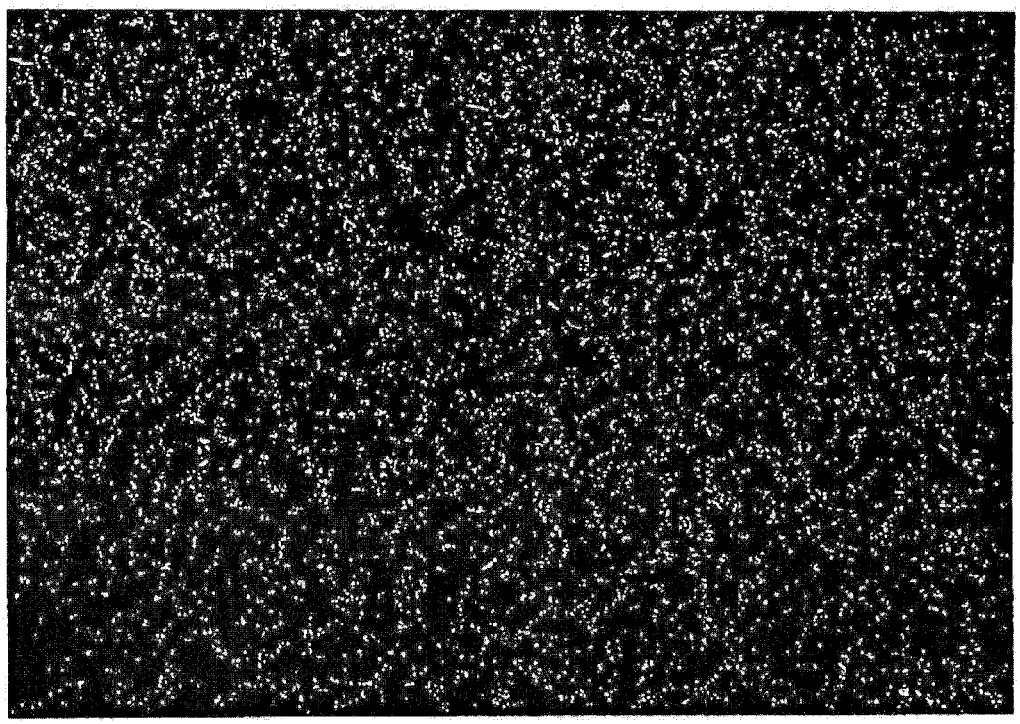

To illustrate the cleaning done in accordance with the present invention, micrographs of textured casting roll surfaces 12A are shown in FIGS. 17 through 19. As shown, the casting roll surfaces are not pristine clean. There are residuals in the low areas and entices in the casting surface, and not even all exposed projections of the casting roll surface are effectively clean. However, a substantial number of the projections are visible with exposed surfaces as shown, and are cleaned sufficiently that the formation of crocodile skin roughness is inhibited or eliminated during casting. By rotating brushes cleaning the casting roll surfaces as shown in FIGS. 17 through 19, the casting roll surfaces 12A can be wetted by the molten metal in the casting pool 10, and heat flux can be effectively transmitted from the molten metal to the casting rolls when the casting surfaces are in contact with the casting pool while crocodile skin roughness is inhibited.

Figure 20:
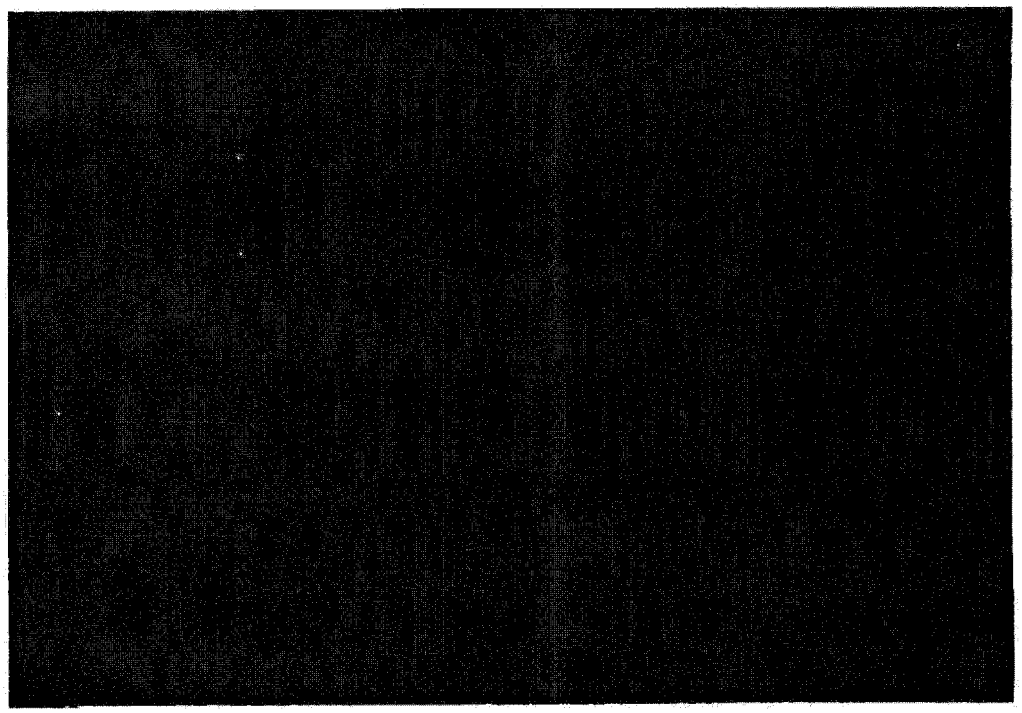
FIGS. 20 and 21 are photomicrographs of textured casting roll surfaces that were not properly cleaned in accordance with the present invention for purposes of illustration.
Figure 21:
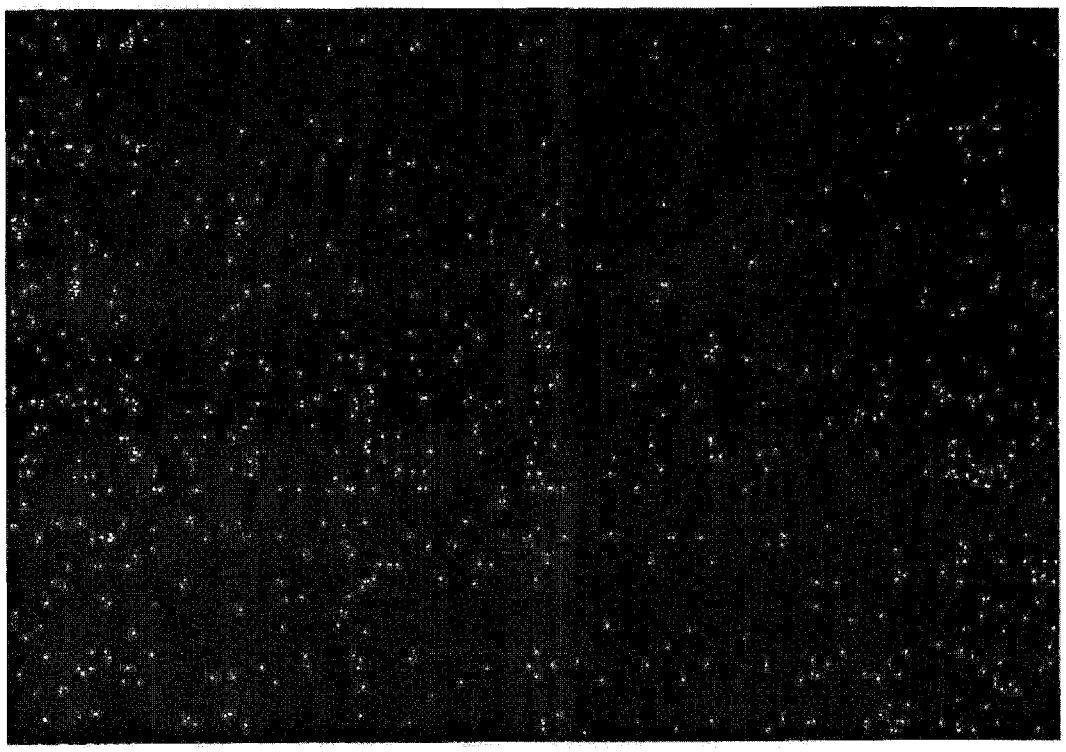

FIGS. 20 and 21 are provided for purposes of comparison. FIGS. 20 and 21 show where the projections of the textured casting roll surface 12A are "buried" beneath the molten melt and the casting surfaces are not exposed so that is effective heat flux from the molten metal to the casting roll surfaces in accordance with the present invention.

Figure 22:
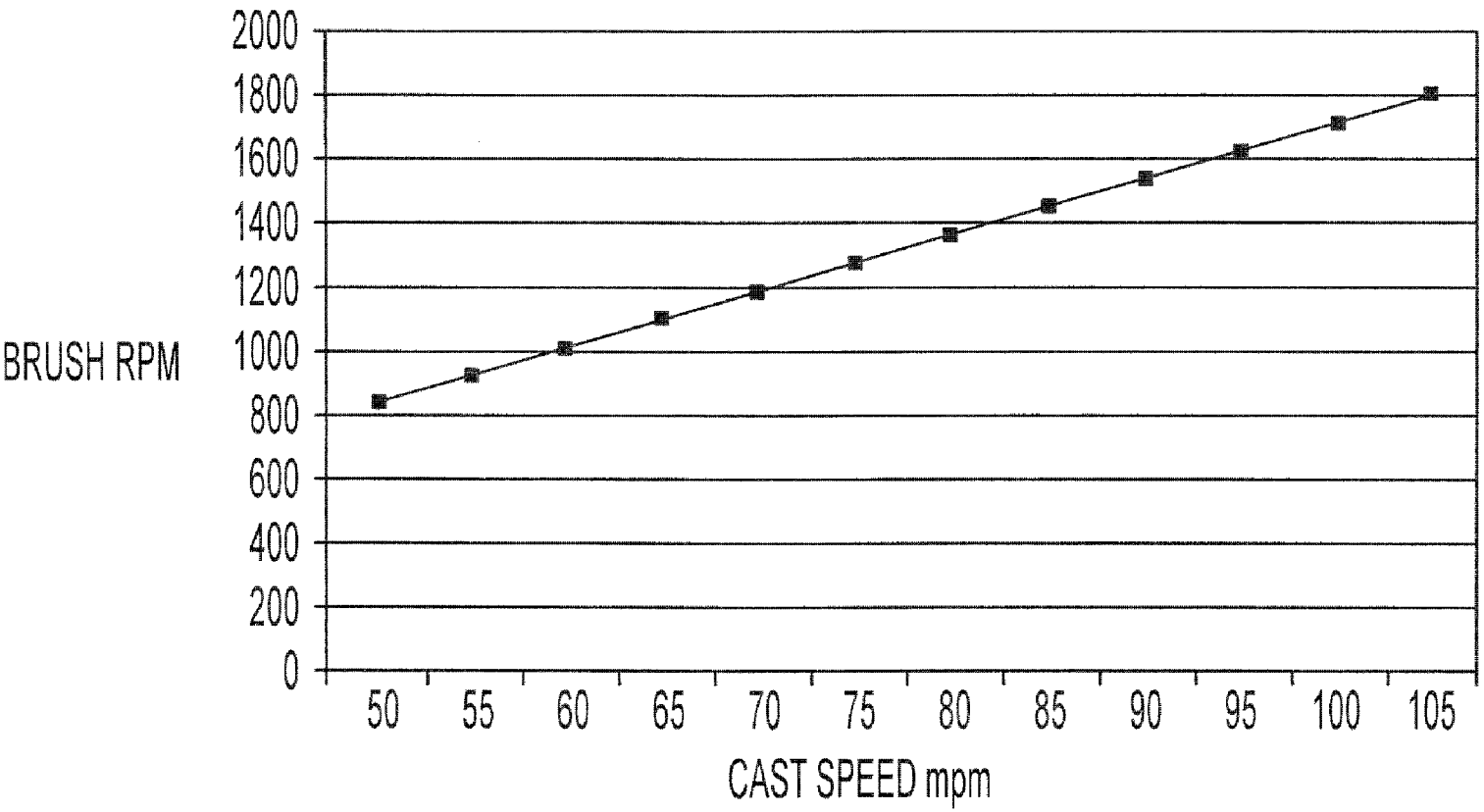
FIG. 22 is a graph showing the relationship between rotational speed of the sweeper brush and the casting speed of the caster.

We have also found that the cleaning efficiency requires maintaining a relationship between the rotational speed of the cleaning brush of the sweeper brush and the casting speed with the caster. FIG. 22 is a graph showing the relationship for a particular embodiment of the invention that has been built. Similar relationships can be empirically derived for other embodiments of the invention. This relationship provides for control of the energy of the brushes exerted against the casting surfaces to be maintained during the casting campaign.

Figure 23:
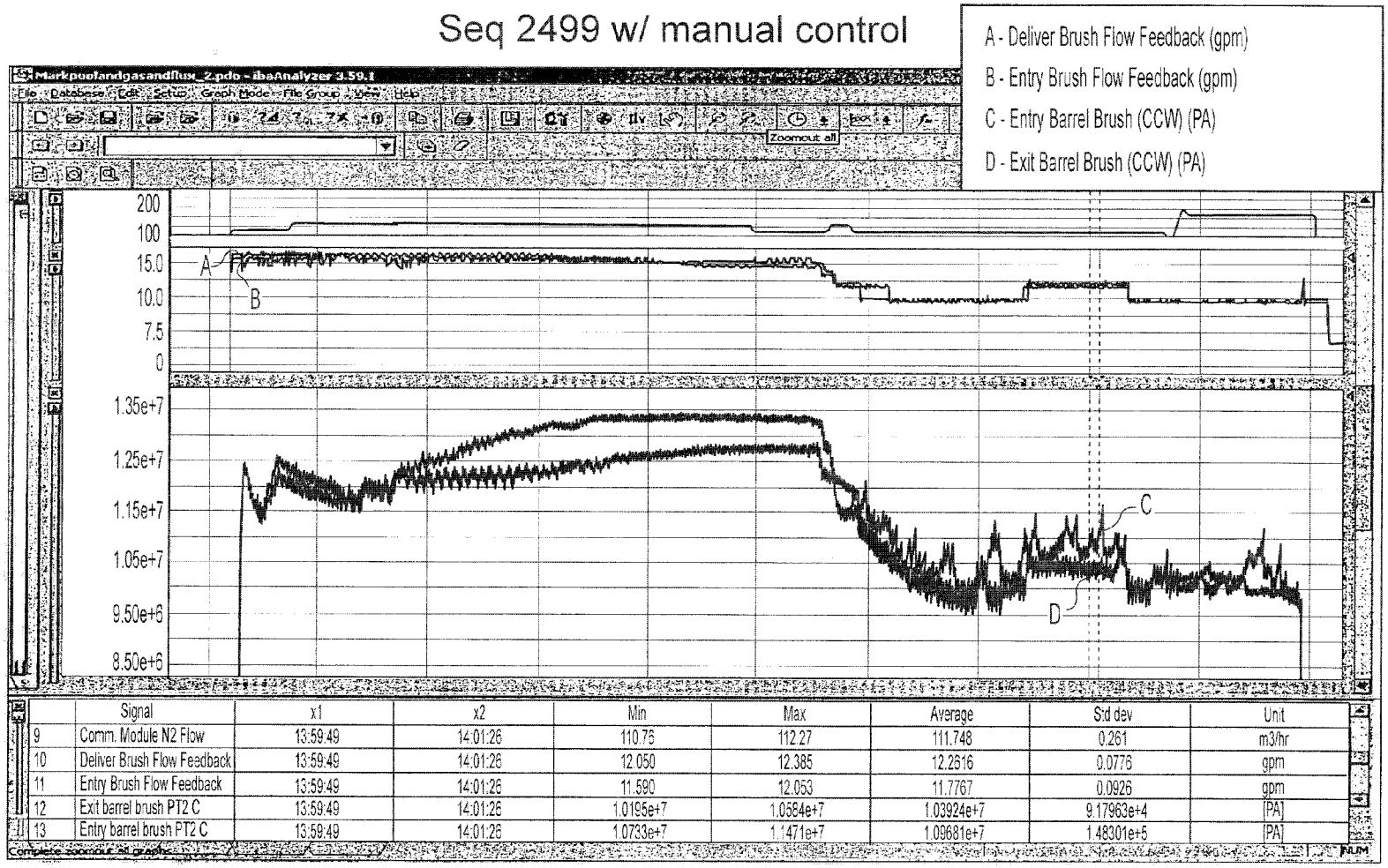
FIG. 23 is a plot of the hydraulic flow through hydraulic motors powering rotating brushes, as well as the differential in pressure of the hydraulic fluid across the hydraulic motors, with manual control.

Shown in FIG. 23 is the control of the energy exerted by the brushes on the casting surface to control the formation of crocodile skin roughness can be done by manually controlling the hydraulic fluid flow through the hydraulic motors and the pressure differential of hydraulic fluid across the hydraulic motors. FIG. 23 reports two ladle sequence 2499. In the upper part of FIG. 23, the hydraulic fluid flow through the two hydraulic motors is reported in gallons per minute as flow feedback from the flow meter, and in the lower part of FIG. 23, the hydraulic pressure differential of hydraulic fluid across the two hydraulic motors is reported in Pascals. As shown, the energy exerted by the brushes on the casting surfaces was maintained within tolerances over the two ladle sequence, although the brush rotational speed and hydraulic pressure across the hydraulic motors tended to wander downwardly toward the end on the sequence within tolerances.

Figure 24:
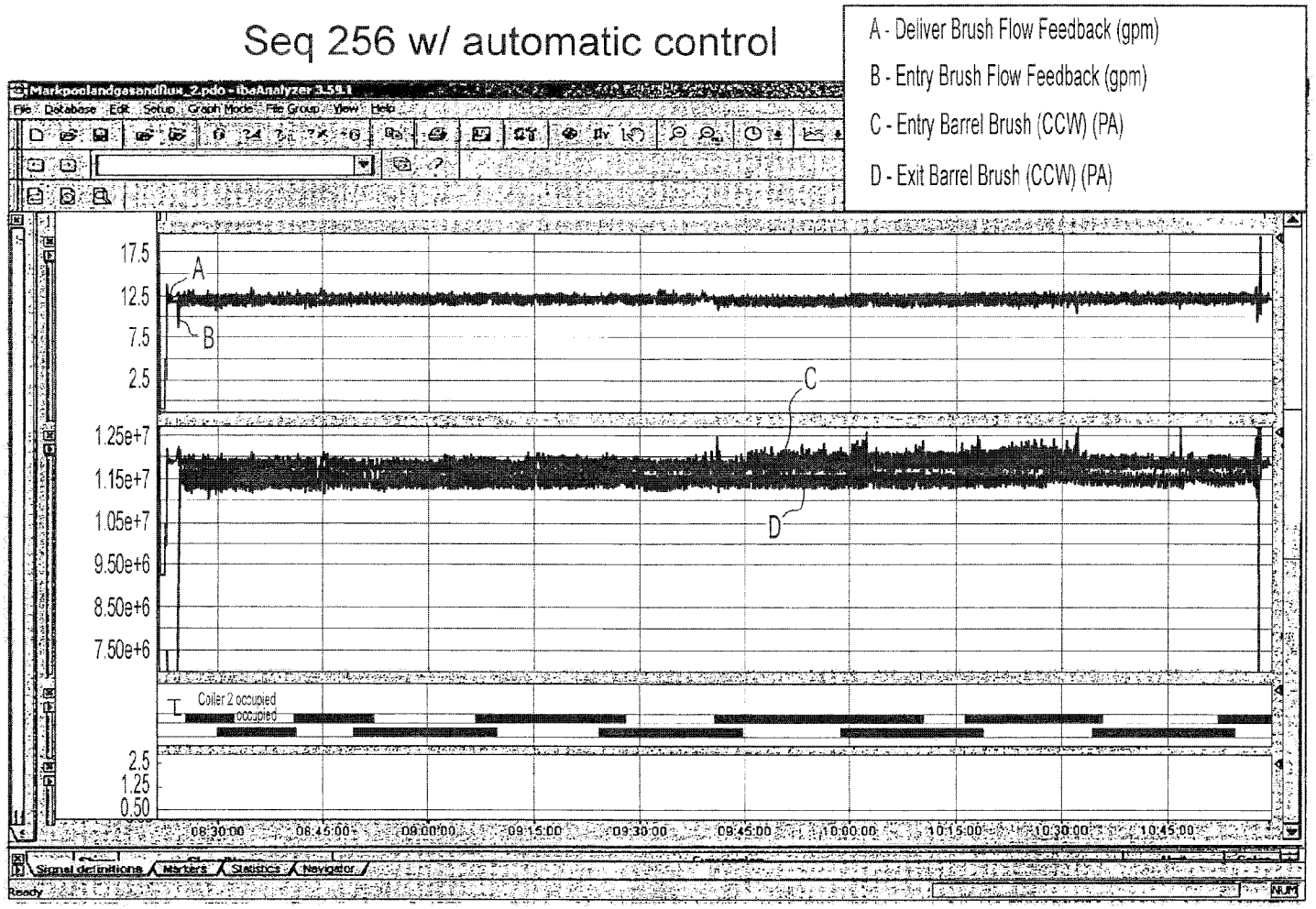
FIG. 24 is a plot of the hydraulic flow through hydraulic motors powering rotating brushes, as well as the differential in pressure of the hydraulic fluid across the hydraulic motors, with automated control.

Shown in FIG. 24 is the control of the energy exerted by the brushes on the casting surface to control the formation of crocodile skin roughness can be done by automated controls controlling the hydraulic fluid flow through the hydraulic motors and the pressure differential of hydraulic fluid across the hydraulic motors. FIG. 24 reports two ladle sequence 256. In the upper part of FIG. 24, the hydraulic fluid flow through the two hydraulic motors is reported in gallons per minute as flow feedback from the flow meter, and in the lower part of FIG. 24, the hydraulic pressure differential of hydraulic fluid across the two hydraulic motors is reported in Pascals. As shown, the energy exerted by the brushes on the casting surfaces was maintained very evenly over the two ladle sequence with the automated controls, and by contrast to FIG. 23, within closer tolerances than with the manual controls of the energy exerted by the brushes on the casting rolls.

Although the invention has been illustrated and described in detail in the foregoing drawings and description with reference to several embodiments, it should be understood that the description is illustrative and not restrictive in character, and that the invention is not limited to the disclosed embodiments. Rather, the present invention covers all variations, modifications and equivalent structures that come within the scope and spirit of the invention. Many modifications may be made to the present invention as described above without departing from the spirit and scope of the invention.

What is claimed is:

1. A method of controlling the formation of crocodile skin surface roughness comprising the steps of:

a. directing an electromagnetic beam source toward the surface of thin cast strip following discharge from casting surfaces of a twin roll caster;

b. detecting reflectance of the electromagnetic beam source from the surface of the thin cast strip;

c. processing the detected reflectance from the surface of the thin cast strip to measure the degree of roughness of the surface of the thin cast strip; and d. based on the measured degree of roughness, controlling energy exerted by brushes against the casting surfaces of the twin roll caster to control the degree of cleaning of the casting surfaces to expose a majority of projections of the casting surfaces of the casting rolls and to control crocodile skin roughness of the thin cast strip.

2. The method of controlling the formation of crocodile skin surface roughness as claimed in claim 1 further comprising:

detecting the specular reflectance from the surface of the thin cast strip.

3. The method of controlling the formation of crocodile skin surface roughness as claimed in claim 1 further comprising:

detecting the diffuse reflectance from the surface of the thin cast strip.

4. The method of controlling the formation of crocodile skin surface roughness as claimed in claim 1 further comprising:

providing a signal corresponding to the electromagnetic beam reflected by the casting surfaces to a device selected from the group consisting of a voltmeter, chart recorder and data logger.

5. The method of controlling the formation of crocodile skin surface roughness as claimed in claim 1 where:

the energy exerted by brushes against the casting surfaces is controlled by varying applied pressure of the brush against the casting surface of the casting roll.

6. The method of controlling the formation of crocodile skin surface roughness as claimed in claim 5 where:

the applied pressure of the brush against the casting roll is measured by measuring torque of a motor rotating the brush.

7. The method of controlling the formation of crocodile skin surface roughness as claimed in claim 1 where:

the energy exerted by brushes against the casting surfaces is controlled by varying rotation speed of the brush against the casting surface of the casting roll.

8. The method of controlling the formation of crocodile skin surface roughness as claimed in claim 7 where:

the rotation speed of the brush against the casting surface is measured by measuring torque of a motor rotating the brush.

9. The method of controlling the formation of crocodile skin surface roughness as claimed in claim 1 where:

the energy exerted by brushes against the casting surfaces is controlled by varying pressure applied by the brush against the casting surface of the casting roll and varying rotation speed of the brush against the casting surface of the casting roll.

10. The method of controlling the formation of crocodile skin surface roughness as claimed in claim 9 where:

the pressure and rotation speed of the rotating brush against the casting surfaces are measured by measuring the torque of a motor rotating the brush.

11. The method of controlling the formation of crocodile skin surface roughness as claimed in claim 1 where the step of controlling the degree of cleaning of the casting surfaces by controlling energy exerted by brushes against the casting surfaces further comprises the steps of:

monitoring the torque of a motor rotating the brush; and based on the measured torque, controlling the energy of the brush against the casting surfaces by varying pressure applied by the brush against the casting surface of the casting roll, by varying rotation speed of the brush against the casting surface of the casting roll, or by a combination thereof.

12. The method of controlling the formation of crocodile skin surface roughness as claimed in claim 1 where:

the energy exerted by the brushes against the casting surfaces is automatically controlled by automated controls during a casting campaign.

13. The method of controlling the formation of crocodile skin surface roughness as claimed in claim 1 where:

the electromagnetic beam has a wavelength of between 400 and 1200 nanometers.

14. The method of controlling the formation of crocodile skin surface roughness as claimed in claim 1 further comprising:

controlling the rotational speed of the brushes in relation to the casting speed.

15. A method of controlling the formation of crocodile skin surface roughness in continuous casting of thin cast strip comprising the steps of:

a. assembling a pair of counter-rotating casting rolls laterally to form a nip between circumferential casting surfaces of the rolls through which metal strip may be cast;

b. forming a casting pool of molten metal of carbon steel of less than 0.065% by weight carbon supported on the casting surfaces of the casting rolls above the nip;

c. assembling a rotating brush peripherally to contact the casting surface of each casting roll in advance of contact of the casting surfaces with the molten metal in the casting pool;

d. directing at least one electromagnetic beam source toward at least one of the casting roll surfaces;

e. detecting the reflectance of at least one electromagnetic beam source from the casting roll surface directed to the surface from the electromagnetic beam source and generating an electronic signal corresponding to the detected reflectance from the casting surface;

f. monitoring the degree of cleaning of the casting surfaces of the casting rolls based on the detected reflectance of the electromagnetic beam source from the casting surface of the casting rolls;

g. based on the monitored degree of cleaning, controlling the energy exerted by the rotating brushes against the casting surfaces of the casting rolls to control the degree of cleaning of the casting surfaces to expose a majority of projections of the casting surfaces of the casting rolls and provide wetting contact between the casting surface and the molten metal of the casting pool and to control the formation of crocodile skin surface roughness; and h. counter-rotating the casting rolls such that the casting surfaces of the casting rolls each travel toward the nip to produce a cast strip downwardly from the nip.

16. The method of controlling the formation of crocodile skin surface roughness in continuous casting of thin cast strip as claimed in claim 15 further comprising:

detecting the specular reflectance from the casting surface of the casting rolls.

17. The method of controlling the formation of crocodile skin surface roughness in continuous casting of thin cast strip as claimed in claim 15 further comprising:

detecting the diffuse reflectance from the casting surface of the casting rolls.

18. The method of controlling the formation of crocodile skin surface roughness in continuous casting of thin cast strip as claimed in claim 15 further comprising:

providing a signal corresponding to the reflectance of light from the casting roll surface to a device selected from the group consisting of a voltmeter, chart recorder and data logger.

19. The method of controlling the formation of crocodile skin surface roughness in continuous casting of thin cast strip as claimed in claim 15 where:

the energy of the rotating brushes against the casting surfaces is controlled by varying the applied pressure of the brushes against the casting surfaces of the casting rolls.

20. The method of controlling the formation of crocodile skin surface roughness in continuous casting of thin cast strip as claimed in claim 19 where:

the applied pressure of the brush against the casting surface is measured by measuring the torque of a motor rotating the brush.

21. The method of controlling the formation of crocodile skin surface roughness in continuous casting of thin cast strip as claimed in claim 15 where:

the energy of the rotating brushes against the casting surfaces is controlled by varying the rotation speed of the brushes against the casting surfaces of the casting rolls.

22. The method of controlling the formation of crocodile skin surface roughness in continuous casting of thin cast strip as claimed in claim 21 where:

the rotation speed of the rotating brush against the casting roll is measured by measuring the torque of a motor rotating the brush.

23. The method of controlling the formation of crocodile skin surface roughness in continuous casting of thin cast strip as claimed in claim 15 where:

the energy of the rotating brushes against the casting surfaces is controlled by varying the pressure applied by the brushes against the casting surfaces of the casting rolls and varying the rotation speed of the brushes against the casting surfaces of the casting rolls.

24. The method of controlling the formation of crocodile skin surface roughness in continuous casting of thin cast strip as claimed in claim 23 where:

the pressure and rotation speed of the rotating brush against the casting roll are measured by measuring the torque of a motor rotating the brush.

25. The method of controlling the formation of crocodile skin surface roughness in continuous casting of thin cast strip as claimed in claim 15 where the step of controlling the energy exerted by the rotating brushes against the casting surfaces further comprises the steps of:

monitoring the torque of motors rotating the brushes; and based on the torque of the motors rotating the brushes, controlling the energy of the brushes against the casting surfaces by varying pressure applied by the brushes against the casting surfaces of the casting rolls, by varying rotation speed of the brushes against the casting surfaces of the casting rolls, or by a combination thereof.

26. The method of controlling the formation of crocodile skin surface roughness in continuous casting of thin cast strip as claimed in claim 15 where:

the energy exerted by the rotating brushes against the casting surfaces is automatically controlled by automated controls during a casting campaign.

27. The method of controlling the formation of crocodile skin surface roughness in continuous casting of thin cast strip as claimed in claim 26 where:

the electromagnetic beam source has a wavelength of between 400 and 1200 nanometers.

28. The method of controlling the formation of crocodile skin surface roughness in continuous casting of thin cast strip as claimed in claim 15 further comprising:

controlling the rotational speed of the brushes in relation to the casting speed.

* * * * *